US007082885B2

(12) United States Patent
Shoji et al.

(10) Patent No.: US 7,082,885 B2
(45) Date of Patent: Aug. 1, 2006

(54) SEWING MACHINE WITH AUTOMATIC THREADING MECHANISM

(75) Inventors: Yoshihisa Shoji, Okazaki (JP); Shinya Fujihara, Nagoya (JP); Noboru Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/169,925

(22) Filed: Jun. 30, 2005

(65) Prior Publication Data

US 2006/0011117 A1 Jan. 19, 2006

(30) Foreign Application Priority Data

Jun. 30, 2004 (JP) ..... 2004-193384

(51) Int. Cl.
*D05B 87/02* (2006.01)

(52) U.S. Cl. ..... 112/225
(58) Field of Classification Search ..... 112/225, 112/220, 241, 302, 255, 221; 223/99
See application file for complete search history.

(56) References Cited

U.S. PATENT DOCUMENTS

| | | | | | |
|---|---|---|---|---|---|
| 3,517,631 | A * | 6/1970 | Weber | 112/225 |
| 4,651,660 | A | 3/1987 | Oshima et al. | |
| 5,069,150 | A * | 12/1991 | Ogawa | 112/241 |
| 5,386,791 | A * | 2/1995 | Sato et al. | 112/302 |
| 5,596,940 | A * | 1/1997 | Yamada et al. | 112/225 |
| 6,779,470 | B1 | 8/2004 | Sakakibara et al. | |
| 6,880,473 | B1 * | 4/2005 | Fukao | 112/225 |
| 2004/0089210 | A1 | 5/2004 | Fukao | |
| 2004/0089211 | A1 | 5/2004 | Hori | |

FOREIGN PATENT DOCUMENTS

JP 2004-65323 A 3/2004

* cited by examiner

*Primary Examiner*—Ismael Izaguirre
(74) *Attorney, Agent, or Firm*—Oliff & Berridge, PLC

(57) ABSTRACT

A sewing machine includes a plurality of thread hooking sections including a thread take-up lever and a thread tension regulator, and a thread guide thread hook mechanism having a thread hook member which is moveable nearly parallel to the vertical surface from a stand-by position to a thread hooking position. The sewing machine is configured to hook the extent of the needle thread from a thread transferring member moved to the vicinity of the eye to the thread take-up lever to hook it onto the needle bar thread guide.

8 Claims, 31 Drawing Sheets

SEWING MACHINE WITH AUTOMATIC THREADING MECHANISM

BACKGROUND OF THE INVENTION

1. Field of the Invention

The present invention relates to a sewing machine that transfers the needle thread drawn from a thread supply with a thread transferring mechanism to hook the needle thread onto a plurality of thread hook sections such as needle bar thread guide etc. with an automatic thread hooking device.

2. Description of the Related Art

In a conventional sewing machine, the needle thread drawn from a thread spool is hooked onto a plurality of thread hooking sections (thread tension regulator, check spring and thread take-up, needle bar thread guide etc.) in a predetermined sequence and path and ultimately transferred to the sewing needle attached to the needle bar. The needle thread is then automatically passed through an eye of a sewing needle and sewing can be started. In case the sewing machine is provided with a threading mechanism, automatic threading is performed to pass the thread through the eye.

Various types of sewing machines have been reduced to practice in which the needle thread drawn from the thread spool is manually hooked onto a plurality of predetermined thread hooking sections on starting the sewing process, while sewing machines have been suggested, in which the needle thread is automatically hooked onto the needle bar thread guide provided on the lower end of the needle bar specifically as a thread hooking section.

For example, the thread hooking device for the thread guide described in JP-A-2004-65323 comprises a base member in the lower portion of the head, a movable member, a rotating arm, a hook member pivotably attached below the moveable member etc. In the thread hooking device so arranged, when the user inserts the cassette to the attachment, the downward operation of the thread cassette induces the threading of the eye. In the threading process, a hook member is shifted from the first stand-by position to the operation position by the first swing and engaged to the needle thread. Then the hook member slides to hook the needle thread onto the needle bar thread guide and returns to the second stand-by position by the second swing.

Because the threading device described in the above patent is configured with numerous members such as the base member, movable member, rotatable arm and the hook member, the thread hooking device suffers from increased size and installation complexity. Furthermore because the hook member in the thread hooking device not only rotates horizontally but slides as well, large space is required in the lower end of the needle bar, which is another problem. Yet furthermore, in case the thread hooking device is applied to a sewing machine that does not use a thread cassette, a separate drive source to horizontally rotate and slide the hook member is required, which demands even larger installing space and increased cost.

SUMMARY OF THE INVENTION

Therefore, an object of the present invention is to provide a sewing machine with a simplified thread guide thread hook mechanism which hooks the thread onto the needle bar thread guide, requiring less installation space.

The present invention provides a sewing machine comprising a needle bar supporting a sewing needle, a thread take-up lever, a needle thread supply, a thread tension regulator, a plurality of thread hooking sections including the thread take-up lever and the thread tension regulator, a needle threading mechanism to automatically pass a needle thread through an eye of the sewing needle, a thread transferring mechanism having a thread transferring member to retain and transfer the needle thread extending from the thread supply, wherein the thread transferring member is moveably arranged to operate up to the vicinity of the eye of the sewing needle and hook the needle thread on the thread take-up lever in the process of the transfer of the thread transferring member as well as having the capability of passing the needle thread through the eye of the sewing needle in co-operation with the needle threading mechanism when transferred to the vicinity of the eye, a needle bar thread guide provided on the lower end of the needle bar, and a thread guide thread hook mechanism having a thread hook member which is moveable nearly parallel to the vertical surface from the stand-by position to the thread hooking position and which hooks the needle thread in the extent from the thread transferring member moved to the vicinity of the eye to the thread take-up lever to hook the needle thread onto the needle bar thread guide.

Because the above configured sewing machine is provided with the needle bar to support the sewing needle, the thread take-up lever, the needle thread supply, the thread tension regulator, a plurality of the thread hooking sections including the thread take-up and the thread tension regulator, the threading mechanism to automatically pass the needle thread through the eye of the sewing needle, the thread transferring mechanism, the needle bar thread guide and a thread guide thread hook mechanism, when the thread transferring member of the thread transferring mechanism is moved to the vicinity of the eye of the sewing needle, the thread hookmember is moved nearly parallel to the vertical surface. Therefore the needle thread can be reliably hooked on the needle bar thread guide in the lower end of the needle bar by hooking the needle thread placed in between the thread transferring member and the thread take-up lever by moving the thread hook member.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
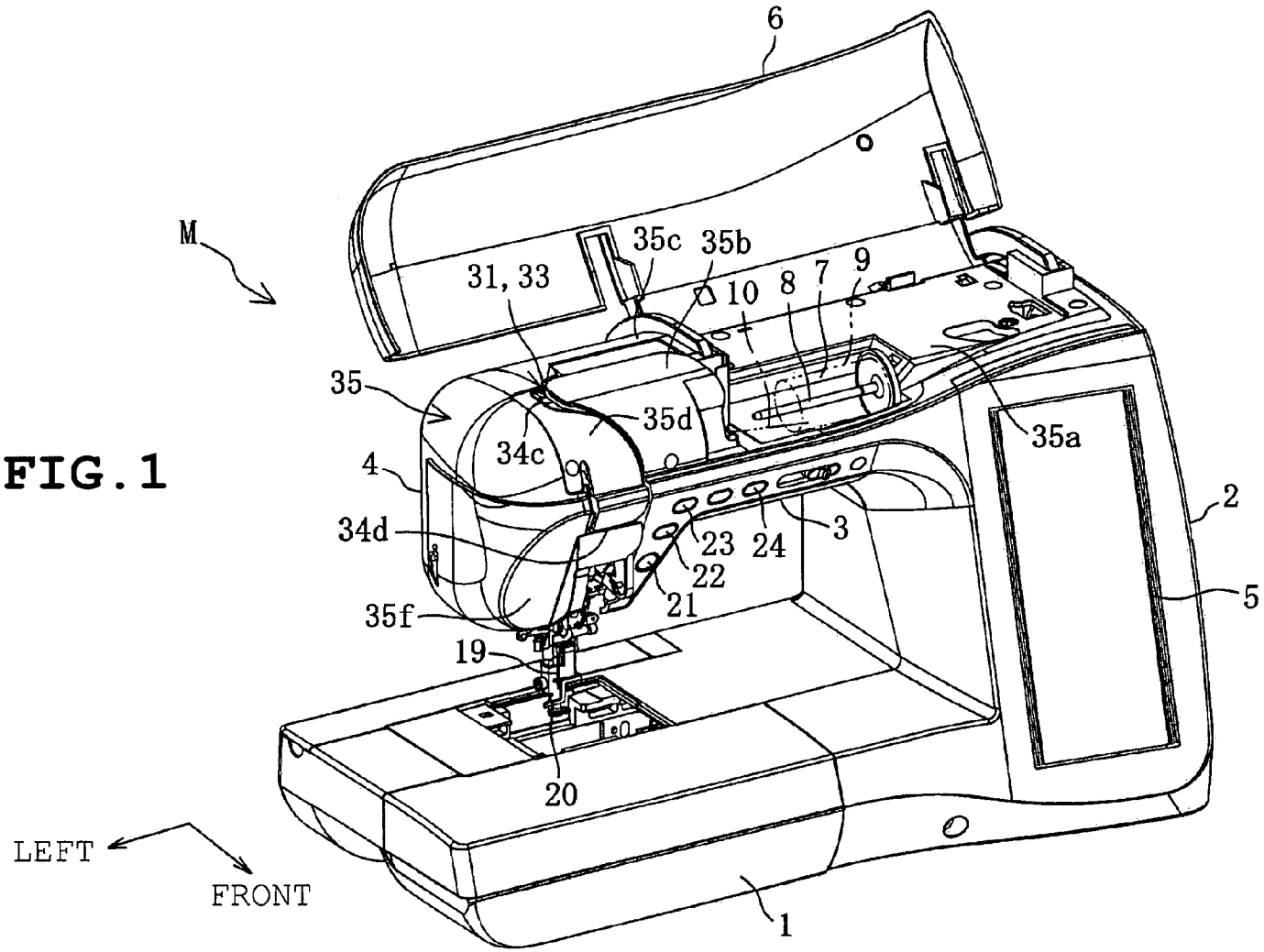
FIG. 1 is a perspective view of a sewing machine of the present invention viewed from the upper side.
Figure 2:
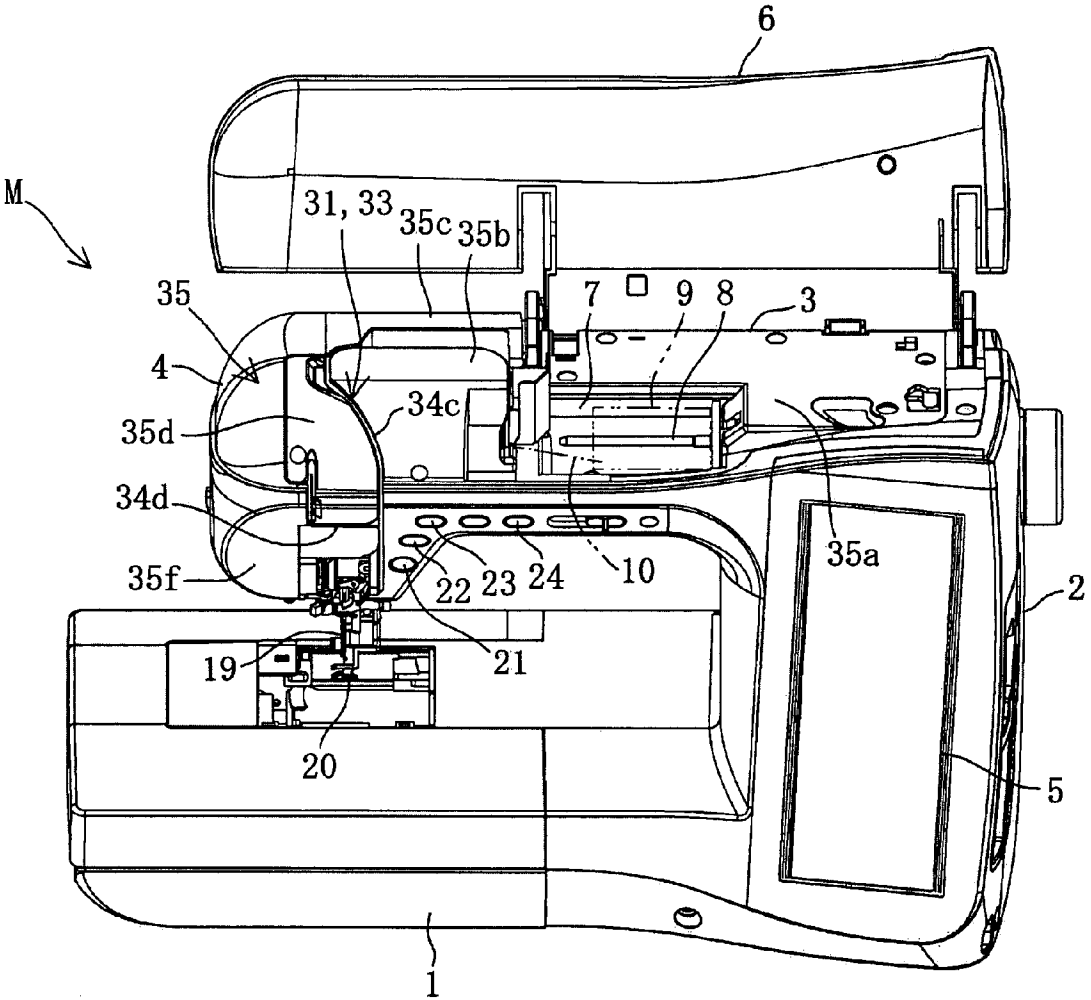
FIG. 2 is a perspective view of the sewing machine viewed from above.
Figure 3:
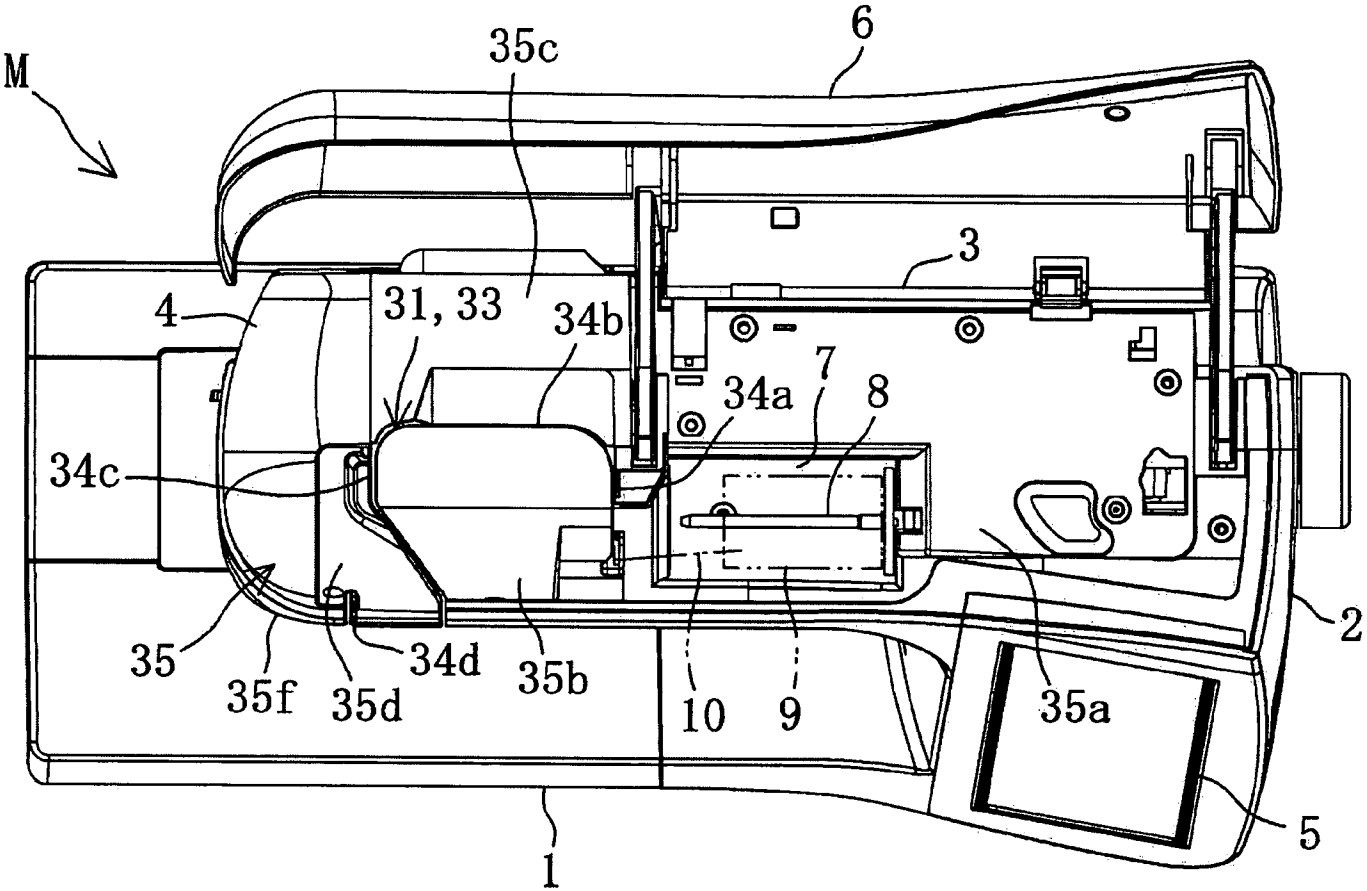
FIG. 3 is a plan view of the sewing machine.
Figure 4:
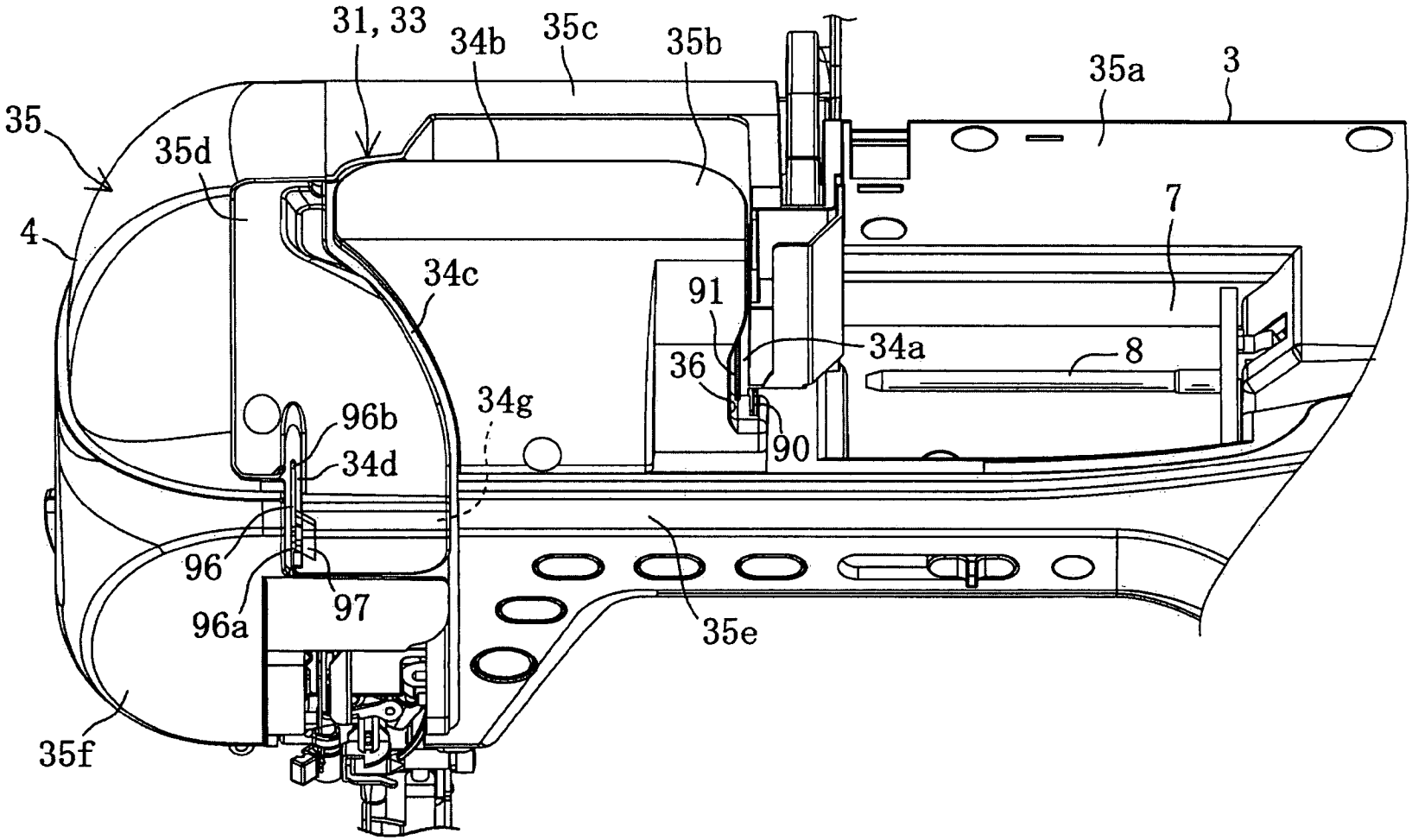
FIG. 4 is an enlarged view of the main part of FIG. 2.

As shown in FIGS. 1 to 3, the sewing machine M is provided with a bed 1, a foot pillar 2 standing on the right side portion of the bed 1, an arm 3 extending to the left from the upper portion of the foot pillar 2 to converge with the bed 1 and a head 4 arranged on the left portion of the arm 3. A needle plate (not shown) below which a rotary hook mechanism (not shown) is placed is arranged on the bed 1. A bobbin wrapped with the lower thread is detachably attached to the rotary hook mechanism. In front of the foot pillar a large type vertical liquid crystal display 5 is arranged.

In the arm 3, an openable cover 6 is mounted. This openable cover is arranged laterally across the entire length of the arm 3 and is pivotally supported about the laterally directed axis in the upper-rear end of the arm 3 in an openable manner. In the right side of the head 4, a thread accommodating concave 7 is formed on top of the arm 3 and a spool pin 8 is arranged in the thread accommodating concave 7. On this spool pin 8, a thread spool 9 serving as a thread supply is attached and this thread spool 9 is accommodated sideways in the lateral direction in the thread accommodating concave 7. The needle thread drawn from this thread spool 9 is transferred sequentially to the plurality of thread hooking sections such as thread tension regulator 14, check spring 15 and thread take-up lever 13 and ultimately supplied to the eye 19*a* of the sewing needle 19 attached to the lower end of the needle bar 11 (refer to FIGS. 12A and 13A).

As shown in FIG. 3 to FIGS. 5 and 8, in the head 4, the needle bar 11, a presser foot 12, the thread take-up lever 13, the thread tension regulator 14, the check spring 15, an automatic thread hooking device 16, and an automatic threading mechanism 17 etc. are provided. The needle bar 11 is supported vertically reciprocably by the sewing machine frame and on the lower end of the needle bar, the sewing needle 11 is attached as well as the arrangement of the needle bar guide 18 thereof. This needle bar 11 is vertically driven by the sewing machine drive mechanism (not shown) having a sewing machine motor 28.

The presser bar 12 is located in the rear of the needle bar 11, supported in vertically reciprocable manner. In the lower end of the presser bar 12, presser foot 20 (refer to FIGS. 1 and 2) is detachably attached. As shown in FIGS. 1 and 2, a sew start switch 21, sew finish switch 22, automatic thread hook preparation switch 23 and automatic thread hook start switch 24 are aligned in a single line in the front side of the arm 3.

The needle bar thread guide 18 provided in the lower end of the needle bar 11 is described herein under. As shown in FIGS. 8 to 11, a needle clamp member 25 is mounted on the lower end of the needle bar. The needle bar thread guide 18 is configured by a horizontally arranged needle thread guide body 26 provided in between the needle bar 11 and the thread clamp member 25 and a horizontally arranged lower thread guide body 27 located below the thread clamp member 25 integrally connected with the needle thread guide body.

However, in the needle thread guide body 26, a leading inlet 26*a* to introduce the needle thread 10 and thread guide 26*b* concatenated with the leading inlet 26*a* is formed. Furthermore, a withholding hook 26*c* is formed to withhold the needle thread in between the leading inlet 26*a* and the thread guide 26*b* so that the needle thread 10 hooked on the leading inlet 26*a* does not slip off. The lower thread guide body 27 is formed as a hook to merely hook the needle thread 10. A horizontal fixed screw 25*a* is attached to the needle clamp member 25 to detachably fix the upper end of the sewing needle 19 to the upper end of the needle bar 11.

Figure 5:
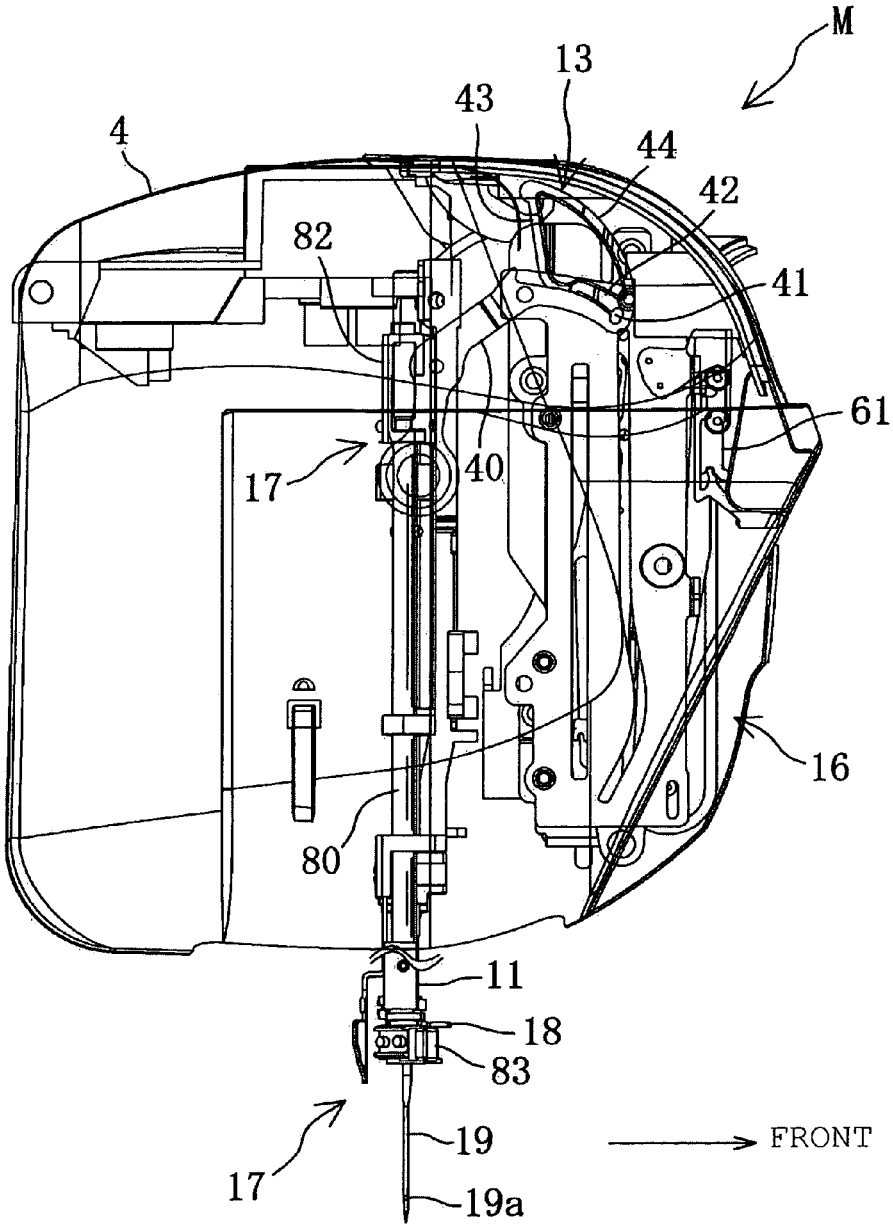
FIG. 5 is a transparent left side view of the sewing machine (automatic thread hook enabled)
Figure 6:
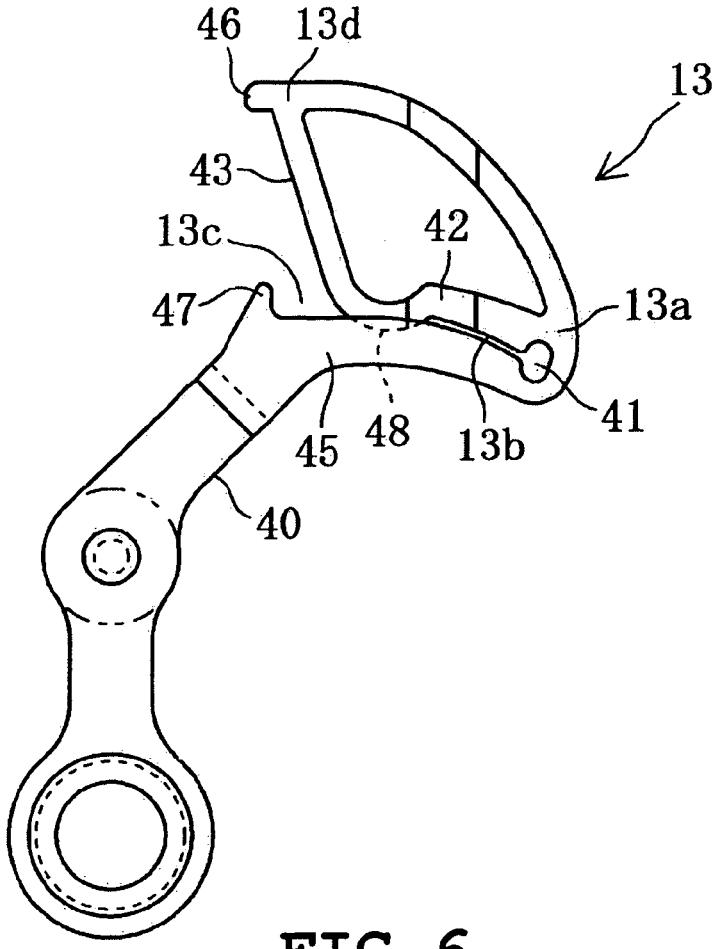
FIG. 6 is a left side view of a thread take-up.
Figure 7:
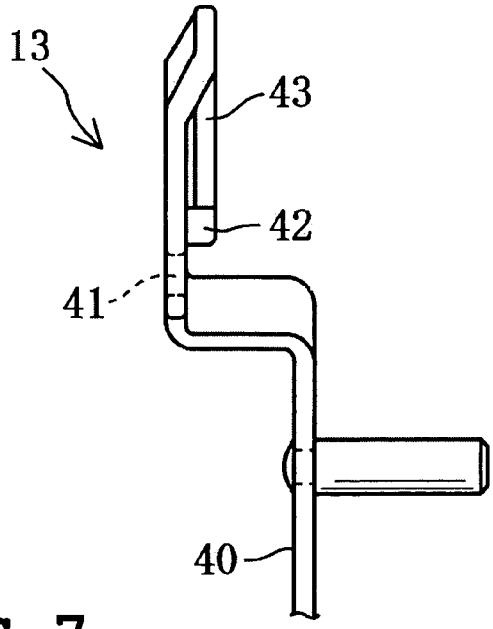
FIG. 7 is a front view of the thread take-up.

Also, as shown in FIGS. 5 to 7, the thread take-up lever 13 is arranged in the front and upper side of the needle bar 11 and as described hereinafter, the lower end of the thread take-up main body 40 which is the base end of the thread take-up lever 13 is rotatably pivoted on the sewing machine frame about the laterally directed axis. This thread take-up lever 13 is vertically swung in synchronization with the needle bar by the sewing machine drive mechanism.

Figure 8:
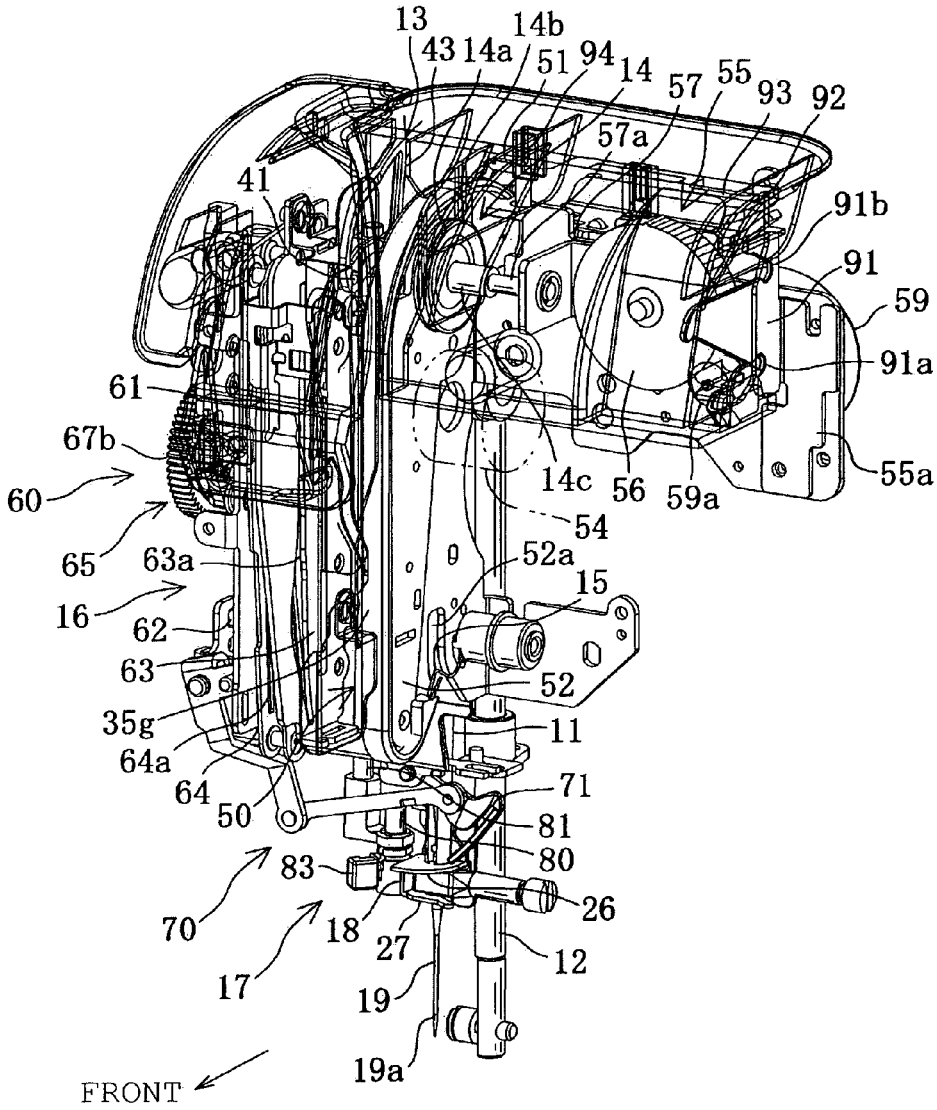
FIG. 8 is a perspective view of an automatic thread hooking device and automatic threading mechanism viewed from the upper-right.
Figure 9:
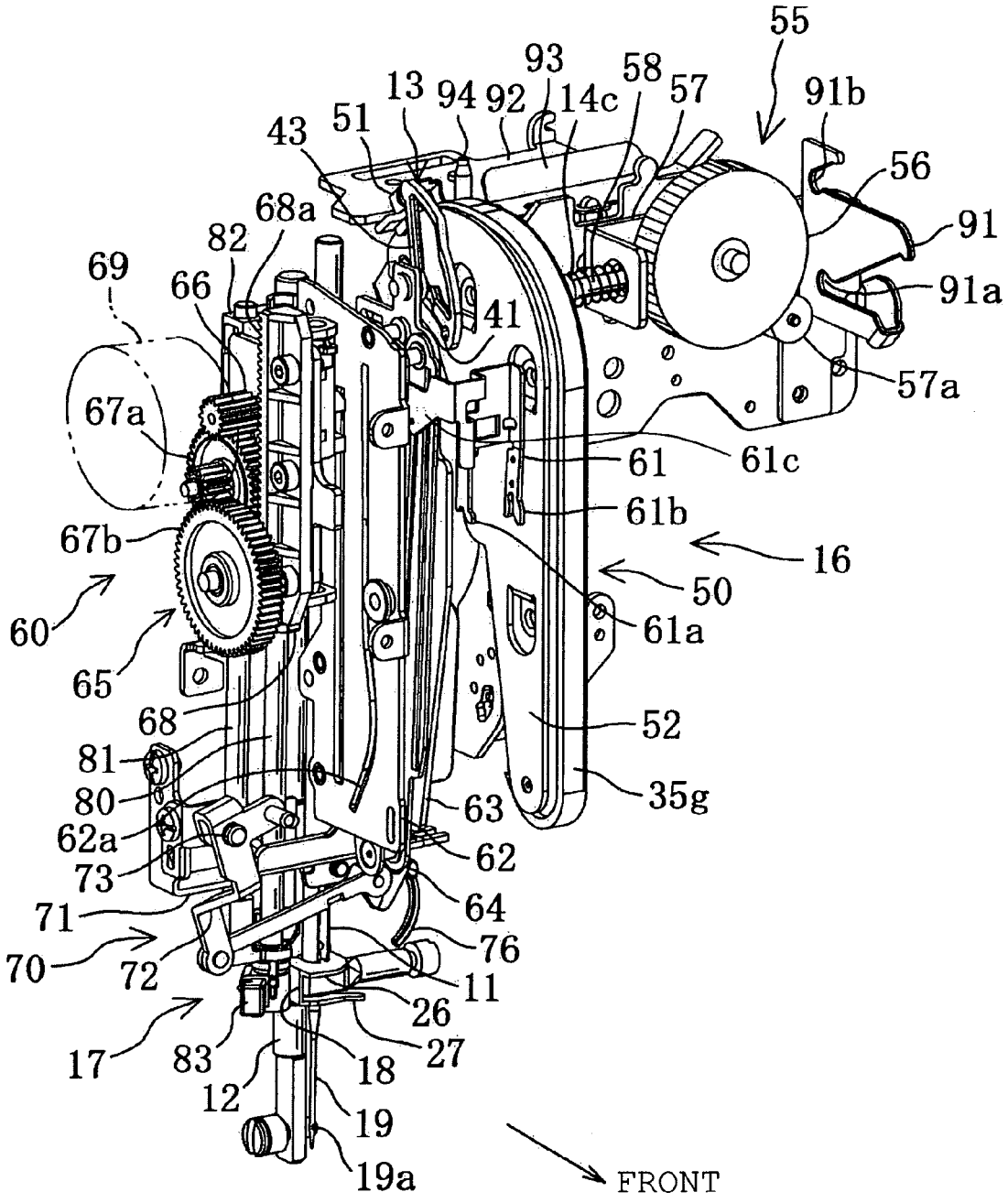
FIG. 9 is a perspective view of the automatic thread hooking device and automatic threading mechanism viewed from the upper-left.

The thread tension regulator 14 having a pair of thread tension discs 14*a* and 14*b* is arranged in a lateral direction, in the thread spool 9 side (upper stream of the thread take-up lever 13) which is located to the right of the thread take-up lever 13 (refer to FIGS. 8 and 12). The above pair of thread tension disks 14*a* and 14*b* are mounted-via the laterally directed thread tension axis 14*c* on the upper end of a first guide frame 52. The check spring 15 is mounted so that the needle thread 10 can be elastically energized in the lower end portion of the first guide frame 52 below the thread tension regulator 14 (upstream of the thread take-up lever 13 and downstream of the thread tension regulator 14).

Now, this sewing machine M as shown in FIGS. 1 to 4, 8, 12A and 13A is provided with a thread preparation path 30 and a thread leading groove 31. The thread preparation path 30 is for arranging the needle thread 10, which is drawn from the thread spool 9 mounted on a spool pin 8 so that it can be hooked on to a plurality of thread hooking sections (thread tension regulator 14, check spring 15, thread take-up lever 13 and needle bar thread guide 18 etc.) by the automatic thread hooking device 16, and also for preparing the needle thread 10 so that it can automatically thread the eye 19*a* of the sewing needle 19 by the automatic threading mechanism 17. The thread leading groove 31 is formed on the sewing machine cover 35 so that the needle thread can be introduced in the thread preparation path 30.

Next, the thread leading groove 31 is described herein under. As shown in FIGS. 1 to 4, the sewing machine cover 35 covering the top of the arm 3 has cover parts divided into a plurality of covers such as an upper cover 35*a*, thread pre-lead cover 35*b*, rear cover 35*c*, thread guide cover 35*d*, front cover 35*e* arranged on a large area of the lower-front portion of the arm 3 and a large type face plate 35*f* arranged on a large area of the head 4. The aforementioned thread spool accommodating concave 7 is formed on the upper cover 35*a*.

The left end of the upper cover 35*a* is located in the lateral center of the arm 3. A leading groove 34*a* is formed in between the upper cover 35*a* and a pre-lead cover 35*b* and the leading groove 34*b* is formed in between the pre-lead cover 35*b* and the rear cover 35*d* arranged in the rear of the pre-lead cover 35*b*. Further, a curved leading groove 34*c* is formed in between the thread guide cover 35*d* and the pre-lead 35*b* located to its right and the front cover 35*e* and an L-shaped leading groove 34*d* is formed in between the thread guide cover 35*d* and the face plate 35*f* located below and to its lower left. These leading grooves 34*a*, 34*b* and 34*c* form a linear connection and the leading groove 34*d* is connected to the lower end of the leading groove 34*c*. The thread leading groove 31 is configured from these pluralities of leading grooves 34*a*, 34*b* and 34*c*.

Now, a brief explanation on the thread take-up lever 13 is given hereinafter. As shown in FIGS. 5–7, the entire figure of the thread take-up lever 13 is of a reverse V shape when viewed from the side, while it is formed in a crank when viewed from the front. The thread take-up lever 13 is driven by the aforementioned sewing machine drive mechanism (not shown) to swing vertically.

This thread take-up lever 13 configured by a thread hook 41 formed integrally with the thread take-up main body 40, thread take-up thread lead 42 and an lead guide 43 to guide the needle thread 10 into thread take-up thread lead 42. The thread take-up thread hook 41 is a small oblong thread hole provided on the thread take-up end point 13*a* and it connects to the thread leading groove 13*b* configured from a gap formed by the thread receiver 45 that bridges the thread take-up main body 40 and thread take-up end point 13*a* and the thread take-up lead 42. The needle thread 10 is guided to the thread take-up thread hook 41 via the thread leading groove 13*b*. The lead guide 43 is formed in a straight line having a length nearly equal to the length from the thread leading inlet 13*c*, which is the opening end of the thread leading groove 13*b* to the thread take-up lead 42 and is also inclined by 120 degrees from the thread receiver 45.

On the end 13*d* of the lead guide 43, the first lock 46 is formed to lock the needle thread so that it does not slip off to the opposite side of the thread receiver 45. Also, on the base end of the thread receiver 45, the second thread lock 47 is formed to lock the needle thread 10, so that it does not slip off to the opposite side of the thread take-up thread lead 42.

Also, in the connection of the thread take-up lead and the lead guide 43, a protrusion 48 protruding towards the thread receiver 45 is formed. The protrusion 48 is formed to overlap with the thread receiver 45, when viewed from the side. This protrusion 48 prevents the needle thread 10 introduced into the thread take-up thread hook 41 from coming off through the thread receiver 45 and thread take-up lead 42.

Now the sewing machine M, as shown in FIG. 5, is capable of hooking the needle thread 10 onto the thread preparation path 30 with the thread take-up lever 13 positioned in the thread hook position near the upper limit position. As shown in FIG. 5, when the thread take-up lever 13 is shifted to the thread hook position, the lead guide 43 is inclined by 80 degrees from the horizontal direction forming a slope declining to the forward direction. The thread take-up lead 42 is inclined by 20 degrees from the horizontal direction so that it is in a downward slope declining in the forward direction. The needle thread 10 in the thread preparation path 30 is hooked from the rear of the lead guide 43.

Next, the automatic thread hooking device is described hereinbelow. As shown in FIGS. 8, 9, 12A to 12F, 13A to 13F, 14A to 14F, the automatic thread hooking device 16 comprises a first thread transferring mechanism 50 having a first thread transferring member 51, a first stepping motor 54 (serving as the first drive means) to actuate the first thread transferring mechanism 50, a second thread transferring mechanism 60 having a second thread transferring member 61, and a second stepping motor 69 (serving as the second drive means) to actuate the second thread transferring mechanism 60. The first thread transferring member 51 is a member which transfers the needle thread 10 present on the thread preparation path 30 and hooks it onto a plurality of thread hooking sections (thread tension regulator 14, check spring 15 and thread take-up lever 13). The second thread transferring member 61 is a member which transfers the needle thread 10 residing in the downstream of the thread take-up lever 13 to the sewing needle 19. The thread transferring mechanism in this case is configured from the first thread transferring mechanism 50 and the second thread transferring mechanism.

In case of the above configuration, the first thread transferring mechanism 50, the first thread transferring member 51 hooks the needle thread residing in the upstream of the lead guide 43 of the thread take-up lever 13, transfers it toward the check spring 15 while hooking the needle thread 10 onto the thread tension regulator 14 by the first thread transferring mechanism 50. Once the first thread transferring member 51 reaches the check spring 15, it hooks the needle thread 10 onto the check spring 15. In the first and second thread transferring mechanism 50 and 60, the first and second thread transferring member 51 and 61 hooks the needle thread 10 onto the thread take-up thread hook 41 while transferring the needle thread 10.

Figure 12A:
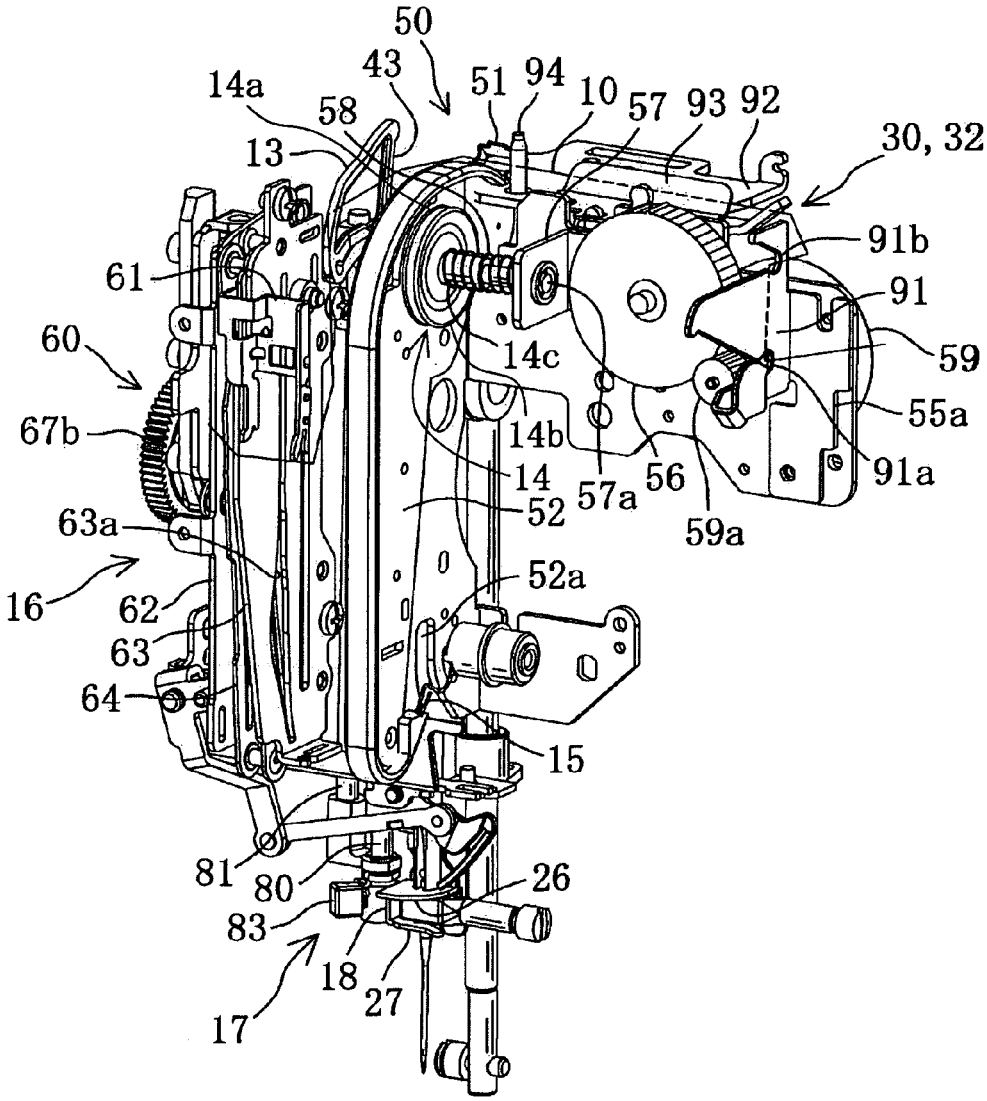
FIG. 12A is a perspective view of the automatic thread hooking device and the automatic threading mechanism (stand-by)
Figure 12B:
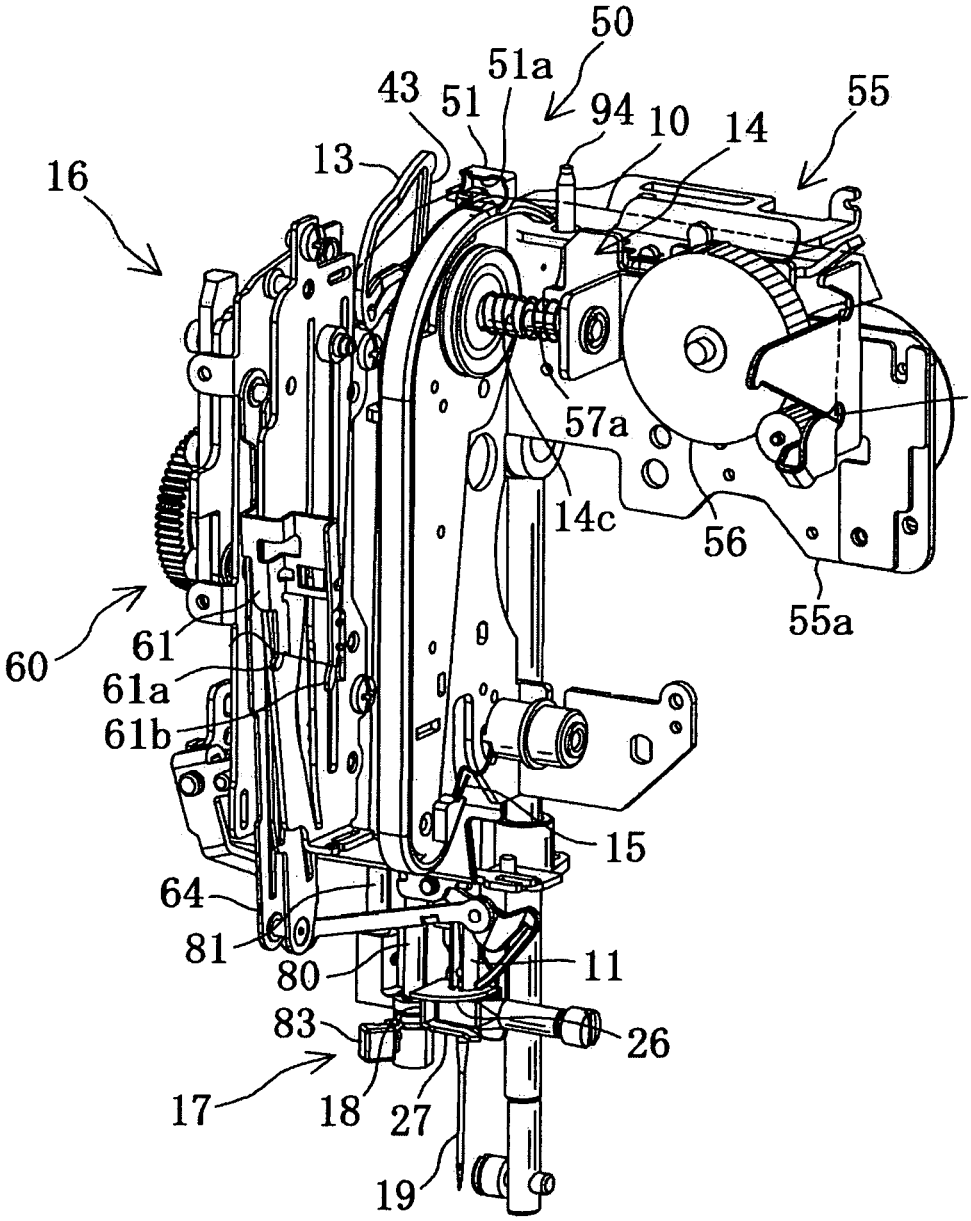
FIG. 12B is a perspective view of the automatic thread hooking device and automatic threading mechanism (thread hooked)
Figure 12C:
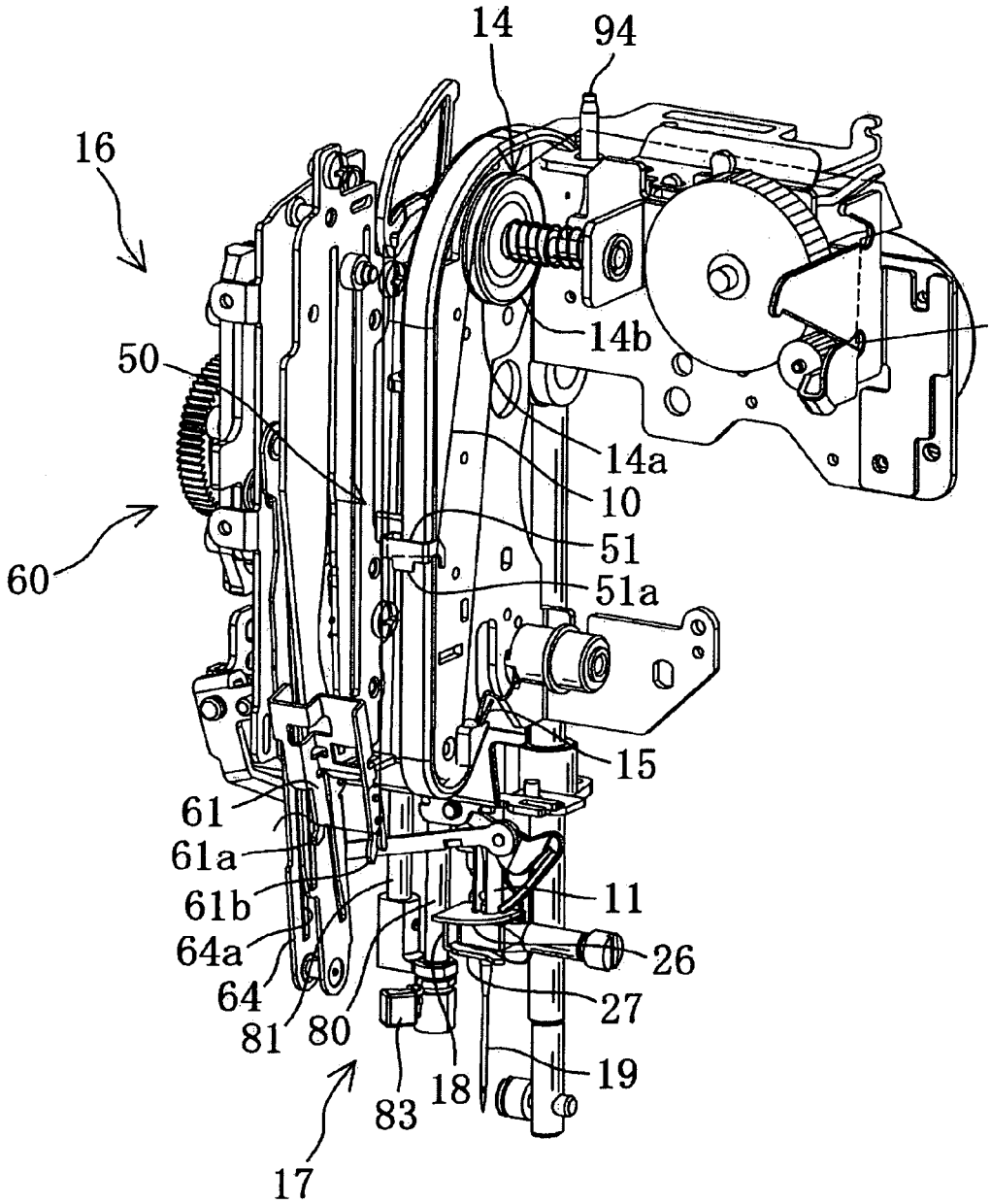
FIG. 12C is a perspective view of the automatic thread hooking device and automatic threading mechanism (thread hooked on thread take-up)
Figure 12D:
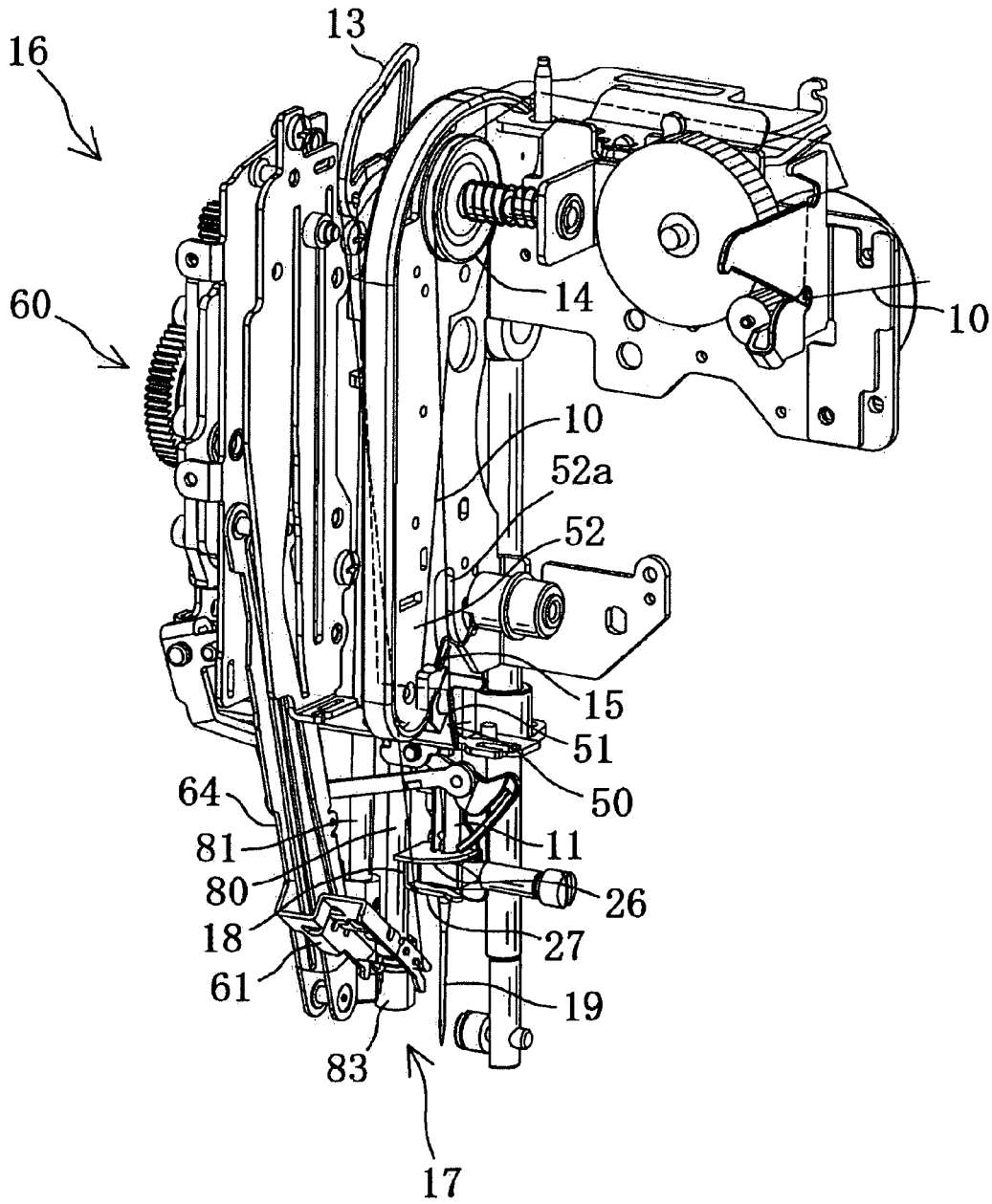
FIG. 12D is a perspective view of the automatic thread hooking device and automatic threading mechanism (thread hooked on check spring)
Figure 13A:
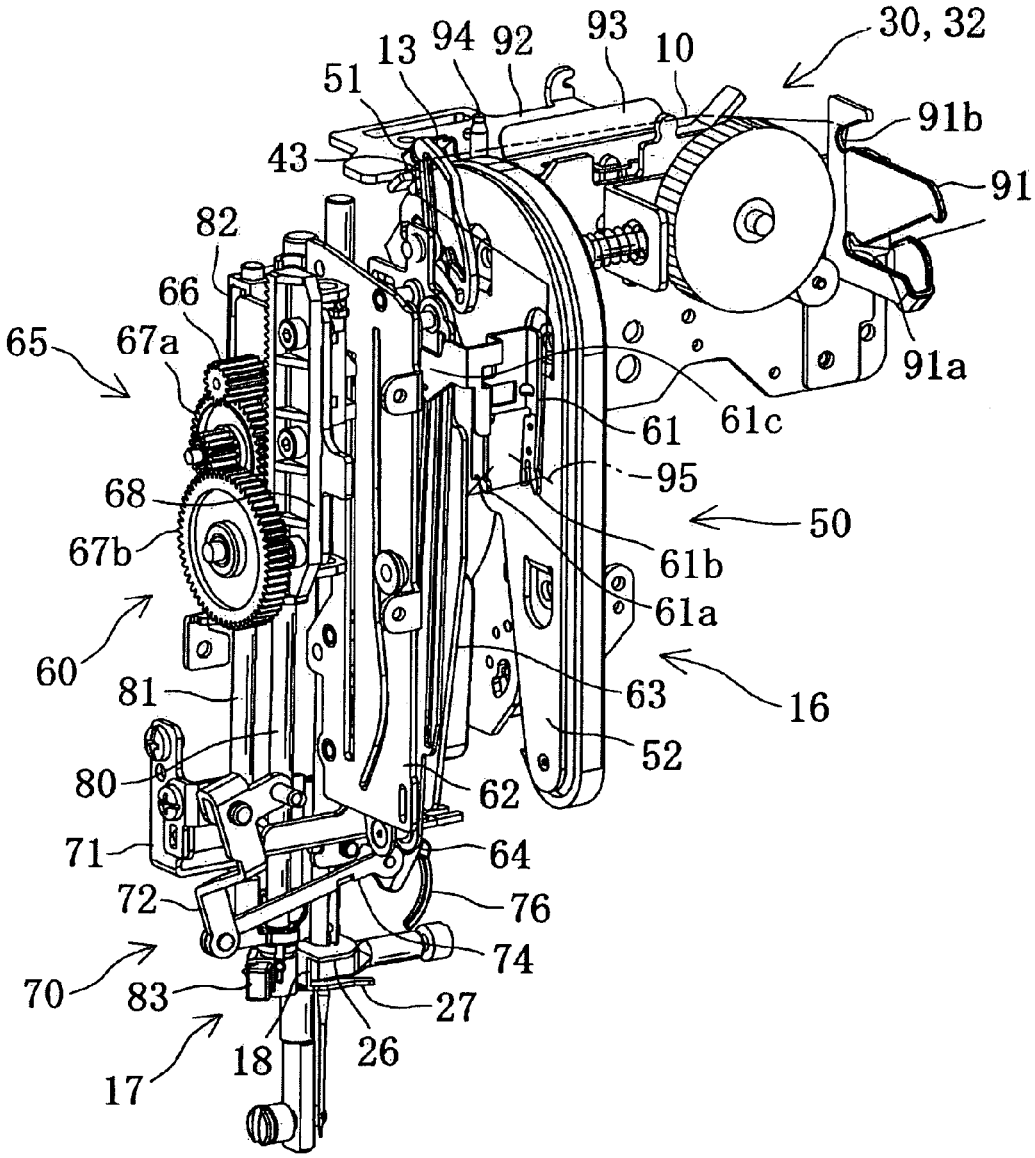
FIG. 13A is a perspective view of the automatic thread hooking device and automatic threading mechanism (stand-by)
Figure 13B:
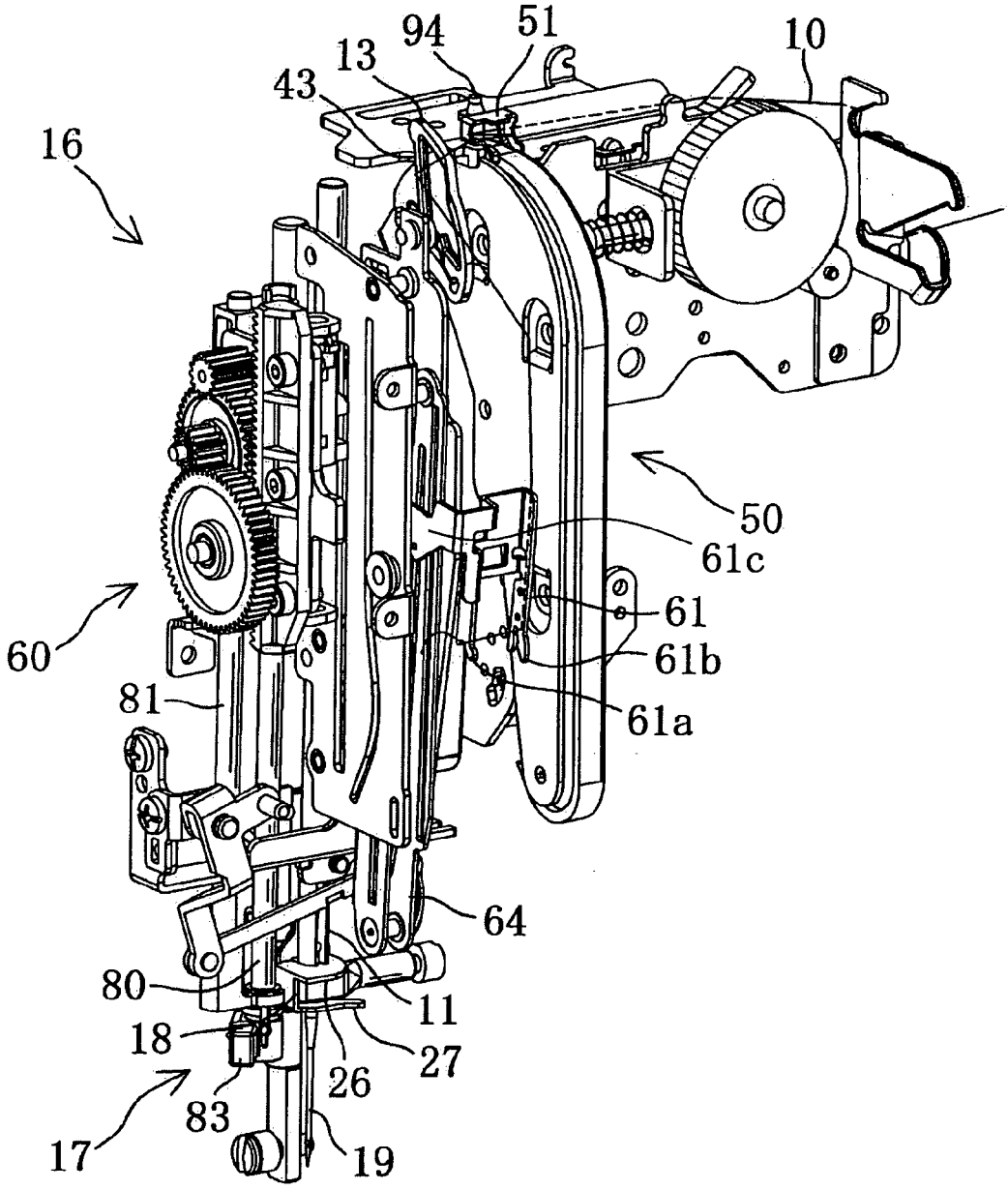
FIG. 13B is a perspective view of the automatic thread hooking device and automatic threading mechanism (thread hooked)
Figure 13C:
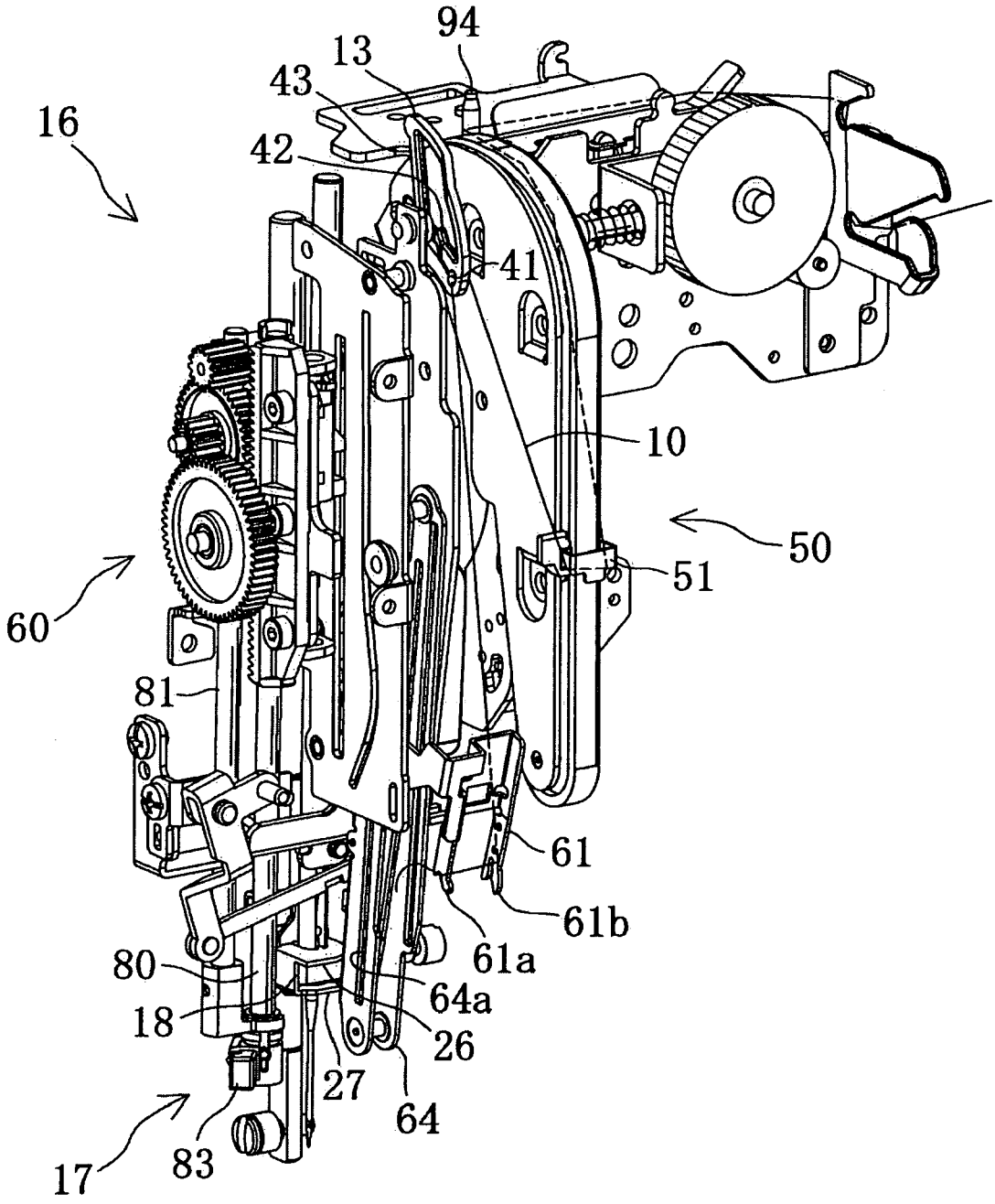
FIG. 13C is a perspective view of the automatic thread hooking device and automatic threading mechanism (thread hooked on thread take-up)
Figure 13D:
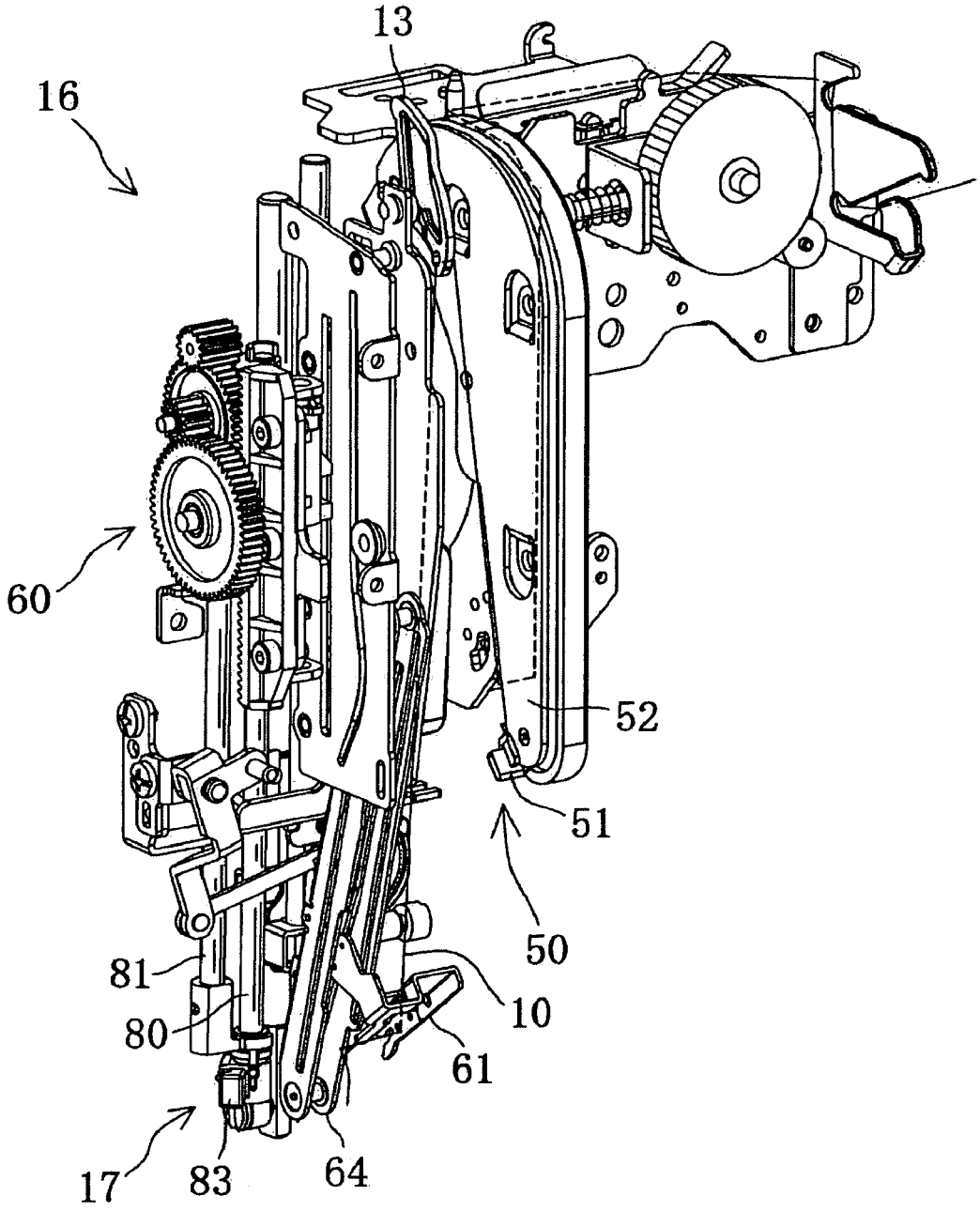
FIG. 13D is a perspective view of the automatic thread hooking device and automatic threading mechanism (thread hooked on check spring)
Figure 14A:
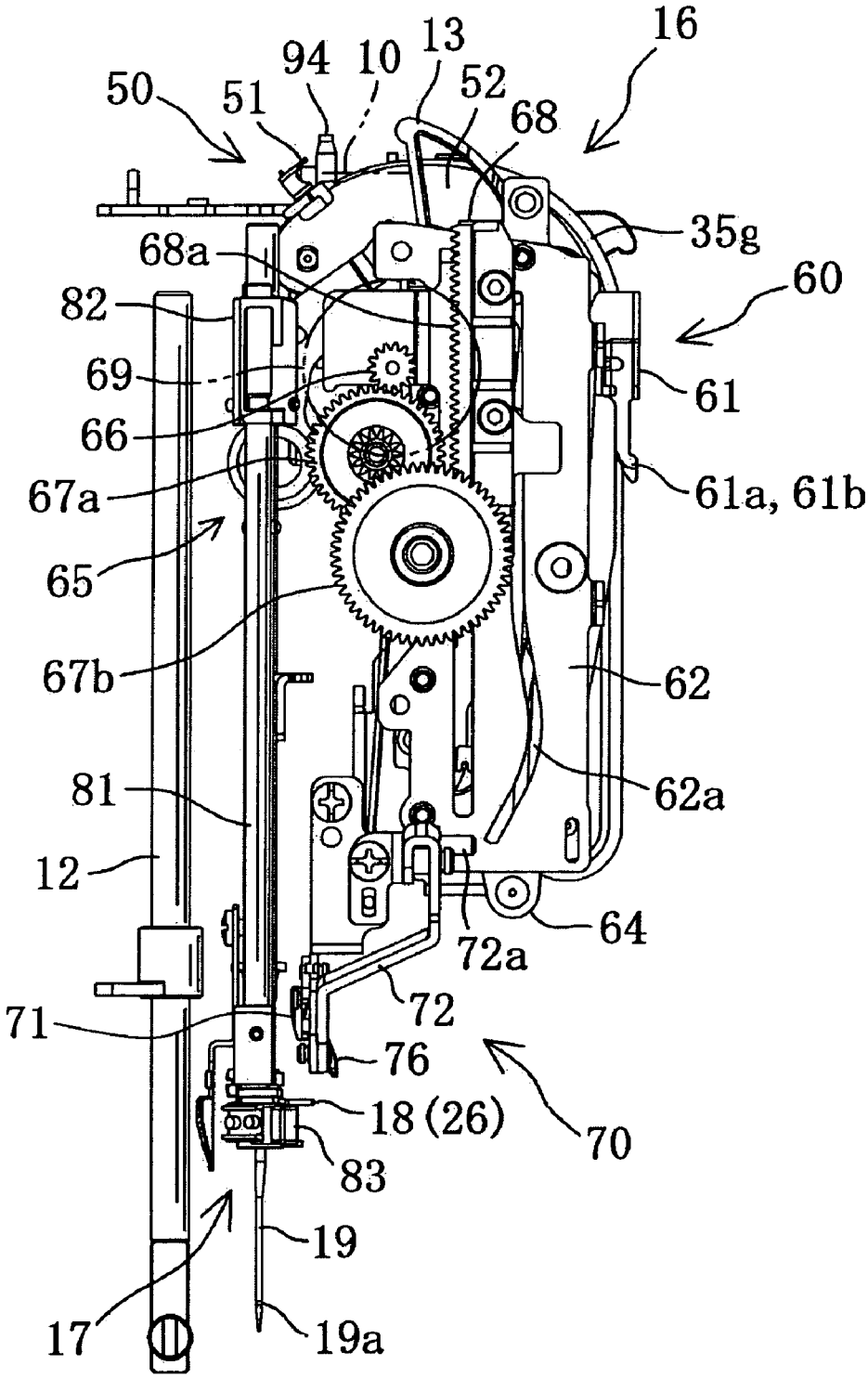
FIG. 14A is a side view of the automatic thread hooking device and automatic threading mechanism (stand-by)

The first thread transferring mechanism 50 is provided with the first guide frame 52 fixed on the sewing machine frame, the first thread transferring member 51 which is guided and supported by the first guide frame and vertically moveable across the stand-by position shown in FIGS. 12A, 13A and 14A and the thread turnover position shown in FIGS. 12D and 13D, and the first drive mechanism (not shown) which actuates the first thread transferring member 51.

The first guide frame 52 is fixed on the right side of the needle bar 11 and the thread take-up lever 13 in a vertical position and it is of a vertically long plate frame with its surface facing the lateral direction. The first guide frame 52 is formed in a series of large-diameter circular arc on the upper edge, a long vertically extending linear front edge, and a small-diameter circular arc on the lower edge.

On the upper end portion of the right hand surface of the first guide frame 52, thread tension disks 14*a* and 14*b* are mounted via thread tension axis and on the lower end portion of the first guide frame 52, a check spring 15 energized by a spring is mounted. On the lower portion of the first guide frame 52, a notch 52*a* is formed concaving inwardly from the lower end towards the upper end, and the check spring 15 is faced to it. The check spring 15 is arranged to fulfill the thread capturing function on the needle thread 10 engaged from below via the notch 52*a*.

Figure 14B:
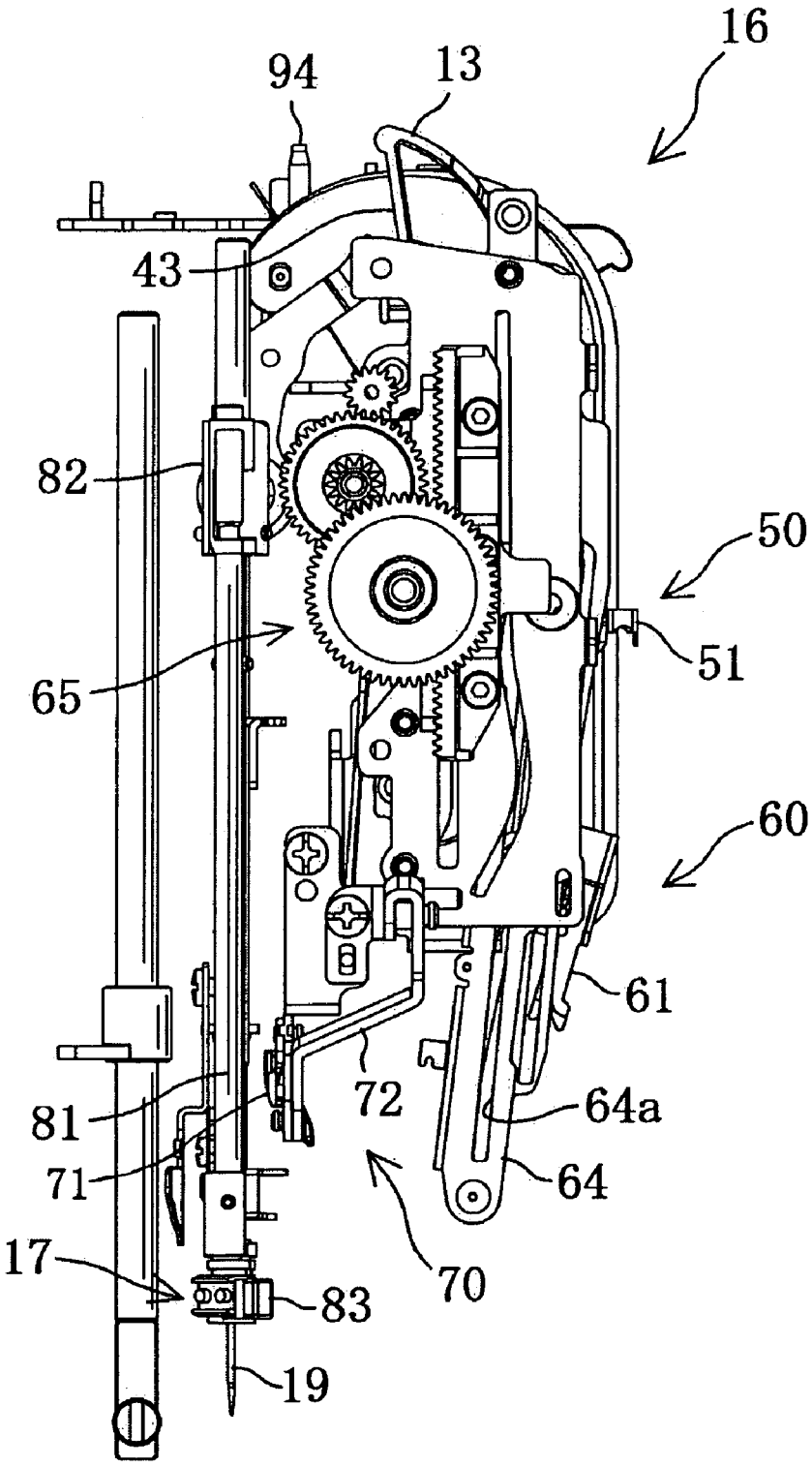
FIG. 14B is a side view of the automatic thread hooking device and automatic threading mechanism (thread hooked)
Figure 14C:
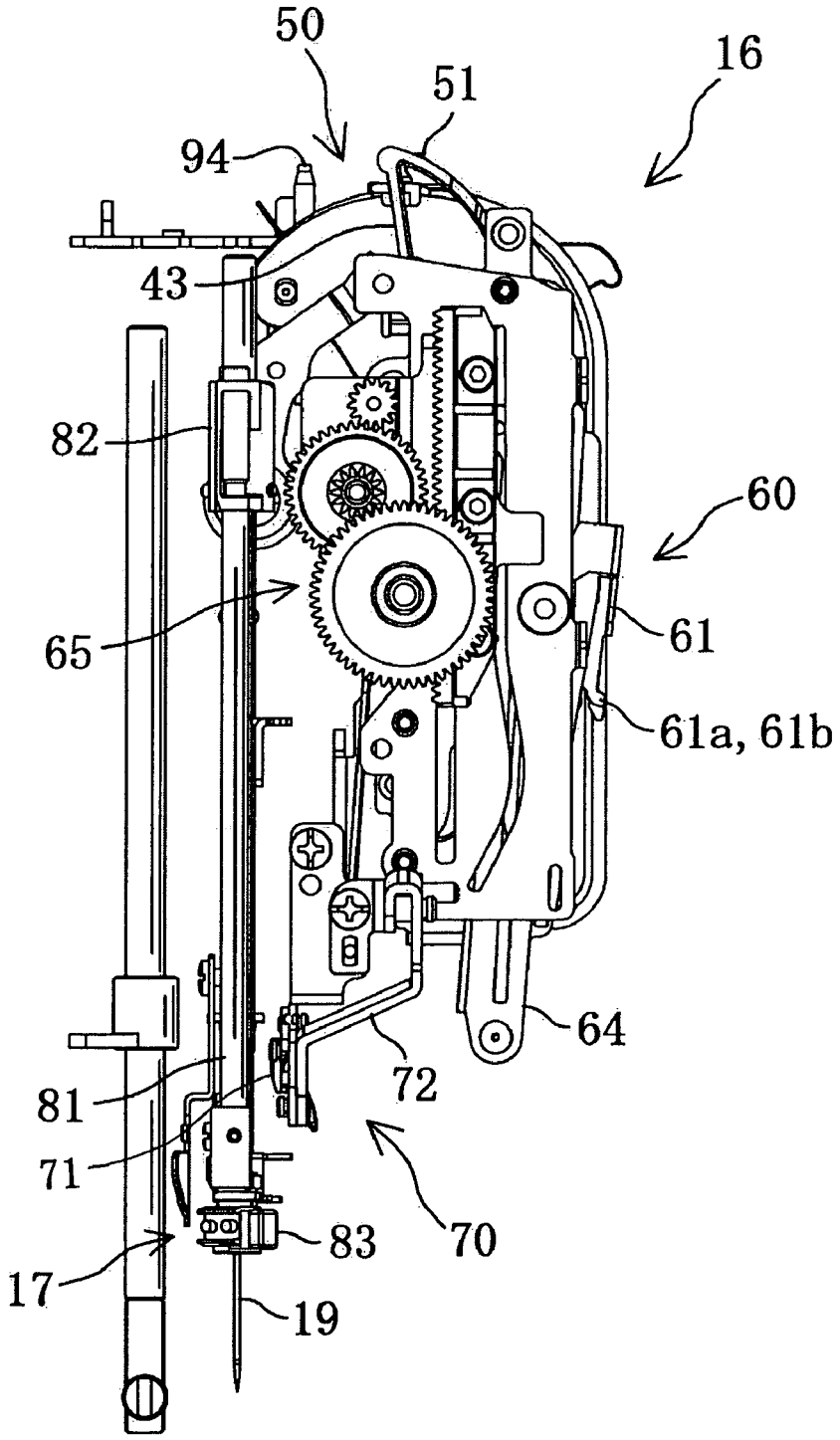
FIG. 14C is a side view of the automatic thread hooking device, automatic threading mechanism (thread hooked on thread take-up)
Figure 14D:
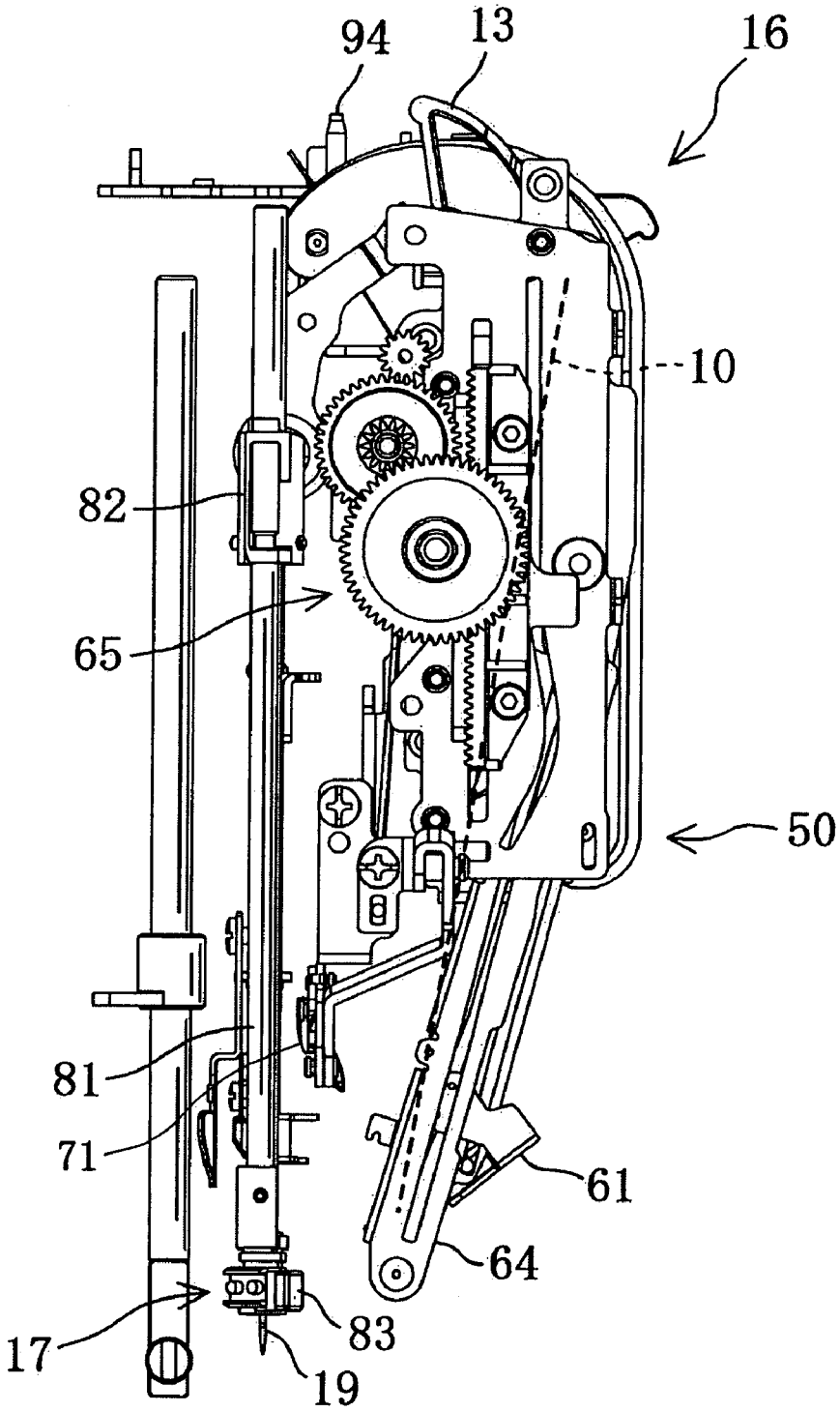
FIG. 14D is a side view of the automatic thread hooking device, automatic threading mechanism (thread hooked on check spring)

The stand-by position of the first thread transferring member 51 as shown in FIGS. 12A, 13A and 14A is the transfer start position on the upper-end rear of the first guide frame. The thread turnover position of the first thread transferring member 51 as shown in FIGS. 12D, 13D and 14D is the transfer finish position in the lower-end rear of the first guide frame 52. Therefore, the first thread transferring member 51 moves uninterruptedly from the stand-by position in the upper side to the thread turnover position in the lower side along the upper edge, front edge and lower edge of the first guide frame 52. In the first thread transferring member 51, a thread hooking member 51*a* protruding forward in the stand-by position and a foot supporting the thread hooking member 51*a* are formed respectively. The first thread transferring member 51 is guided and supported moveably from the stand-by position to the thread turnover position by the engagement of the foot and the edge of the first guide frame 52.

On moving from the stand-by position to the thread turnover position, the first thread transferring member 51 moves downward while hooking a part of the needle thread 10 already hooked on the thread preparation path 30 onto the thread hooking member 51*a* and hooks the needle thread located in the upper stream of the first carrier member 51 on to the thread tension regulator 14. The first thread transferring member 51 is halted when it reaches the thread turnover position in the lower side.

Thus, when the first thread transferring member 51 reaches the thread turnover position and the transferring of the needle thread is halted, the needle thread hooked on the thread hooking member 51*a* is transferred directly below the thread lead 15*b* of the check spring 15. Then, because the second thread transferring member 61 described hereinafter continues to move downward, the needle thread is pulled towards the second thread transferring member 61 by the movement of the second thread transferring member 61. Then the needle thread 10 is removed from the thread hooking member 51*a* and introduced to the notch 52*a* from the lower end and reliably hooked on the check spring 15.

The first drive mechanism not shown is provided with an endless timing belt joined to the first thread transferring member 51 and a guide groove not shown to guide the timing belt along the upper edge, front edge and the lower edge of the guide frame. In the first drive mechanism, the first thread transferring member 51 is driven from the stand-by position to the thread transfer position by driving the timing belt in as recycling manner by the first stepping motor 54 (refer to FIG. 8)

Next, the thread tensioning mechanism 55 having a thread tension regulator 14 is described. The thread tensioning mechanism 55 is provided with a pair of thread tension disks 14*a* and 14*b* to sandwich and apply tension to the needle thread 10, a compressed coiled spring 58 to urge the fixed thread tension disk 14*a* against the moveable thread tension disk 14*b*, a tension adjusting mechanism to variably adjust the elasticity of the compressed coiled spring 58, and a thread tension stepping motor 59 to actuate the tension adjusting mechanism.

Describing the tension adjusting mechanism, a laterally directed mounting plate 55*a* is fixed on the upper end of the first guide frame 52 and a circular tension adjustment gear 56 is rotatably pivoted on the longitudinally directed pivotal axis fixed on the mounting plate 55*a*. On the rear surface of the tension adjusting gear 56, a circular-arc cam (not shown) forming a part of the spiral is formed. On the circular-arc cam, the right end of a thread tension plate 57 (L-shaped in flat view) is engaged and a left directed spring receptor pin 57*a* is fixed on the thread tension plate 57. The end (left end) of the spring receptor pin 57*a* is partly fitted inside the thread tension axis 14*c* fixed on the first guide frame 52 and the compressed coiled spring 58 is placed in between the thread tension disk 14*b* and the thread tension plate 57. The thread tension stepping motor 59 is fixed by the mounting plate 55*a* from the rear side. The drive gear 59*a*, to which the tension adjusting gear 56 is fitted is fixed on the drive axis penetrating the mounting plate 55*a*.

Therefore when the thread tension stepping motor 59 is actuated, the tension adjusting gear 56 is rotationally driven via the drive gear 59*a* and the thread tension plate 57 engagingly connected to the circular-arc cam is moved laterally. In proportion to the distance of the right ward movement of the thread tension regulator 14, the elasticity of the compressed coil spring 58 and the tension of the thread tension regulator 14 are reduced, eventually is reduced to zero.

The second thread transferring mechanism 60 comprises a laterally paired second guide frame 62, 63 fixed in parallel on the sewing machine frame, a moveable frame 64 guided and supported by the second guide frames 62 and 63, the second thread transferring member 61 guided and supported by the moveable frame and a second drive mechanism 65 to actuate the moveable frame 64 and the second thread transferring member 61. The moveable frame 64 is moveable across the retracted position shown in FIGS. 12A, 13A and 14A, and the protruding position shown in FIGS. 12E, 13E and 14E. The second thread transferring member 61 taken together with the movement of moveable frame 64 is moveable across the stand-by position shown in FIGS. 12A, 13A and 14A and the thread transfer position shown in FIGS. 12E, 13E and 14E.

The second guide frames 62 and 63 each of a long vertically extending plate frame having a laterally directed surface are arranged on the left-hand side of the needle bar 11 and the thread take-up lever 13. The second guide frames 62 and 63 are arranged facing each other and are spaced apart in a predetermined distance. In between the two guide frames 62 and 63, the moveable frame 64 is provided so as to be protrudable and retractable. The moveable frame 64 is structured by thin long laterally paired and converging moveable pieces connected together and the second thread transferring member 61 is moveably supported on to the moveable fame 64 via its support section 61*c*.

Vertical guide grooves 62*a* and 63*a* are formed on the second guide frame 62 and 63 respectively and the moveable frame 64 is moveably guided by these guide grooves 62*a* and 63. Also, on one of the moveable pieces of the moveable frame 64, the second thread transferring member 61 is supported via a support section 61*c*.

Figure 12E:
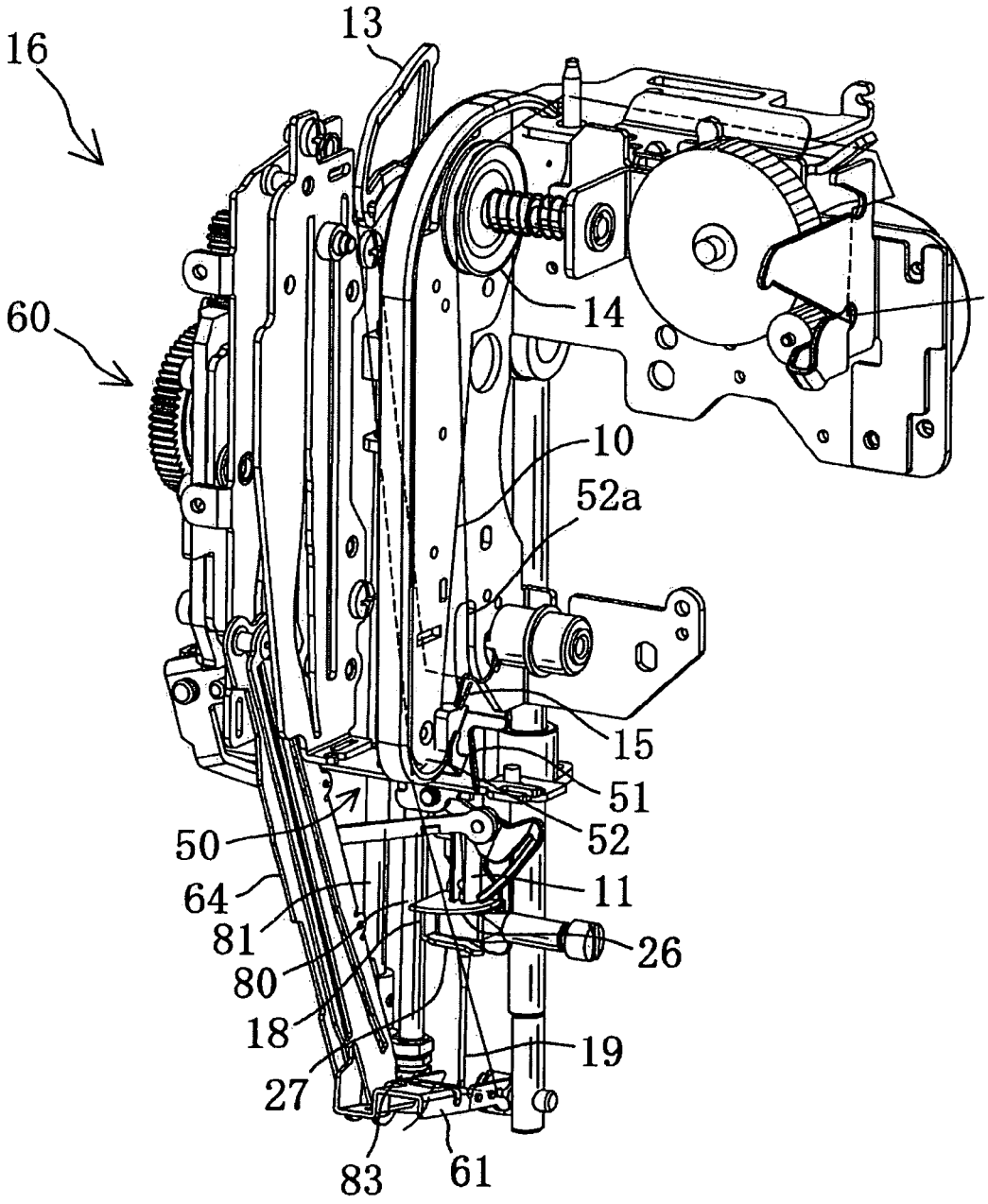
FIG. 12E is a perspective view of the automatic thread hooking device and automatic threading mechanism (thread turnover)
Figure 12F:
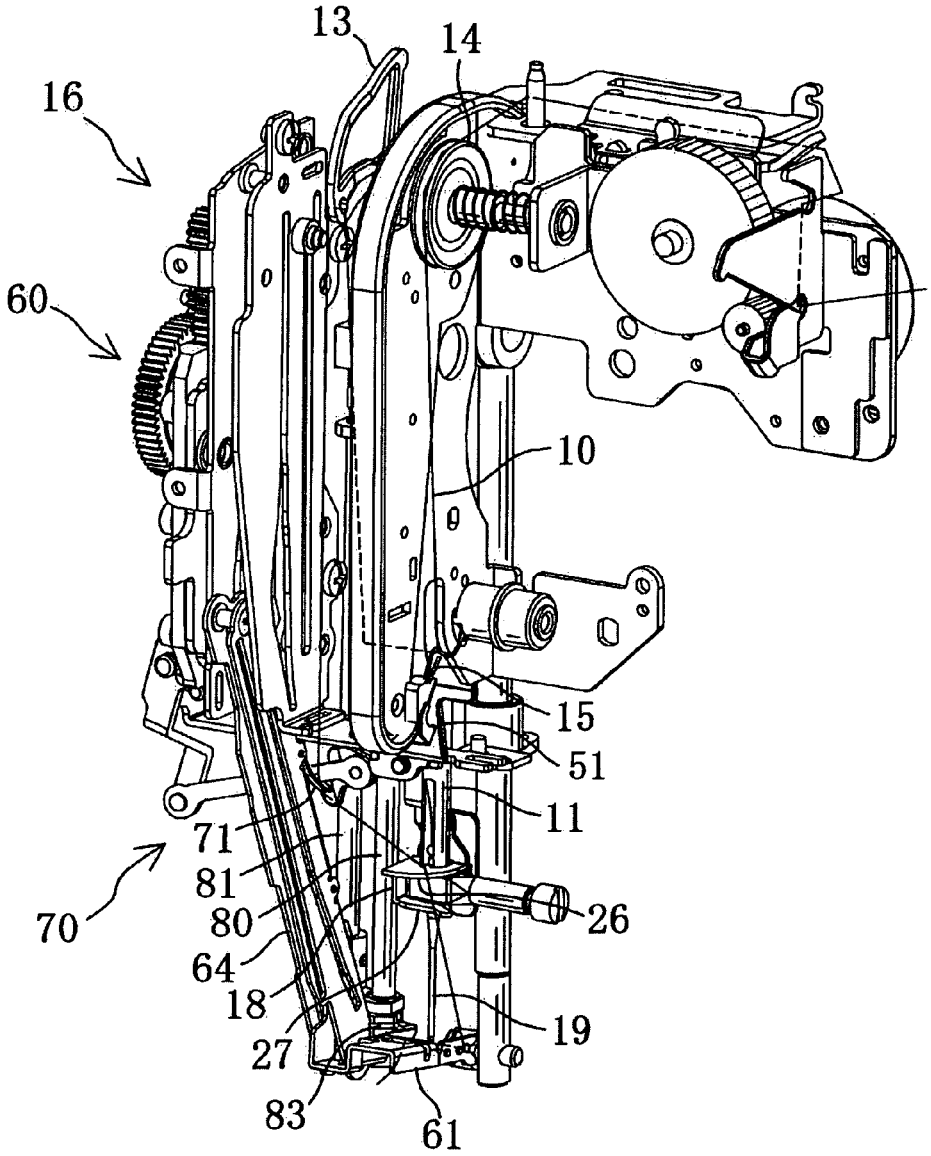
FIG. 12F is a perspective view of the automatic thread hooking device and automatic threading mechanism (thread hooked on needle bar)
Figure 13E:
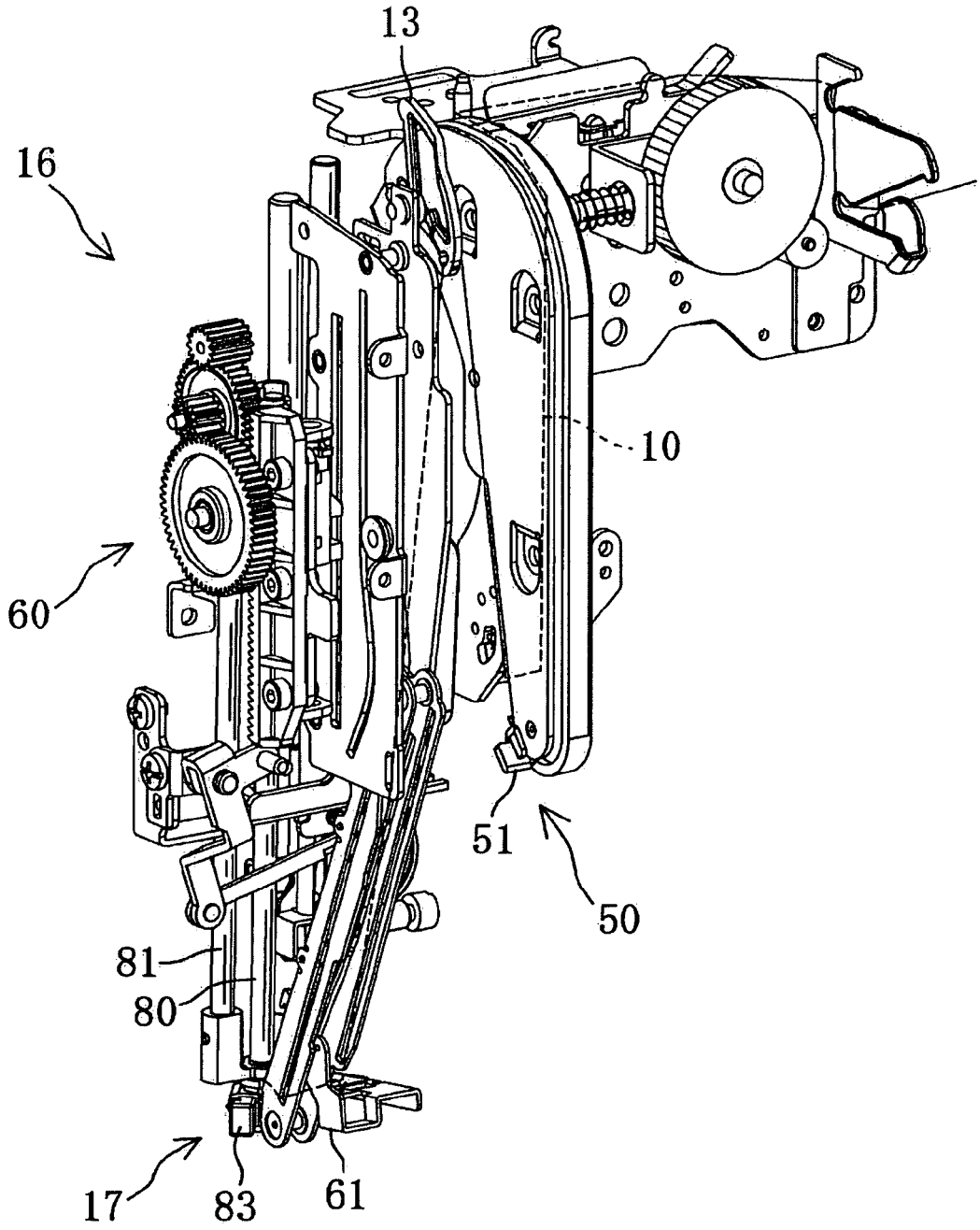
FIG. 13E is a perspective view of the automatic thread hooking device and automatic threading mechanism (thread turnover)
Figure 13F:
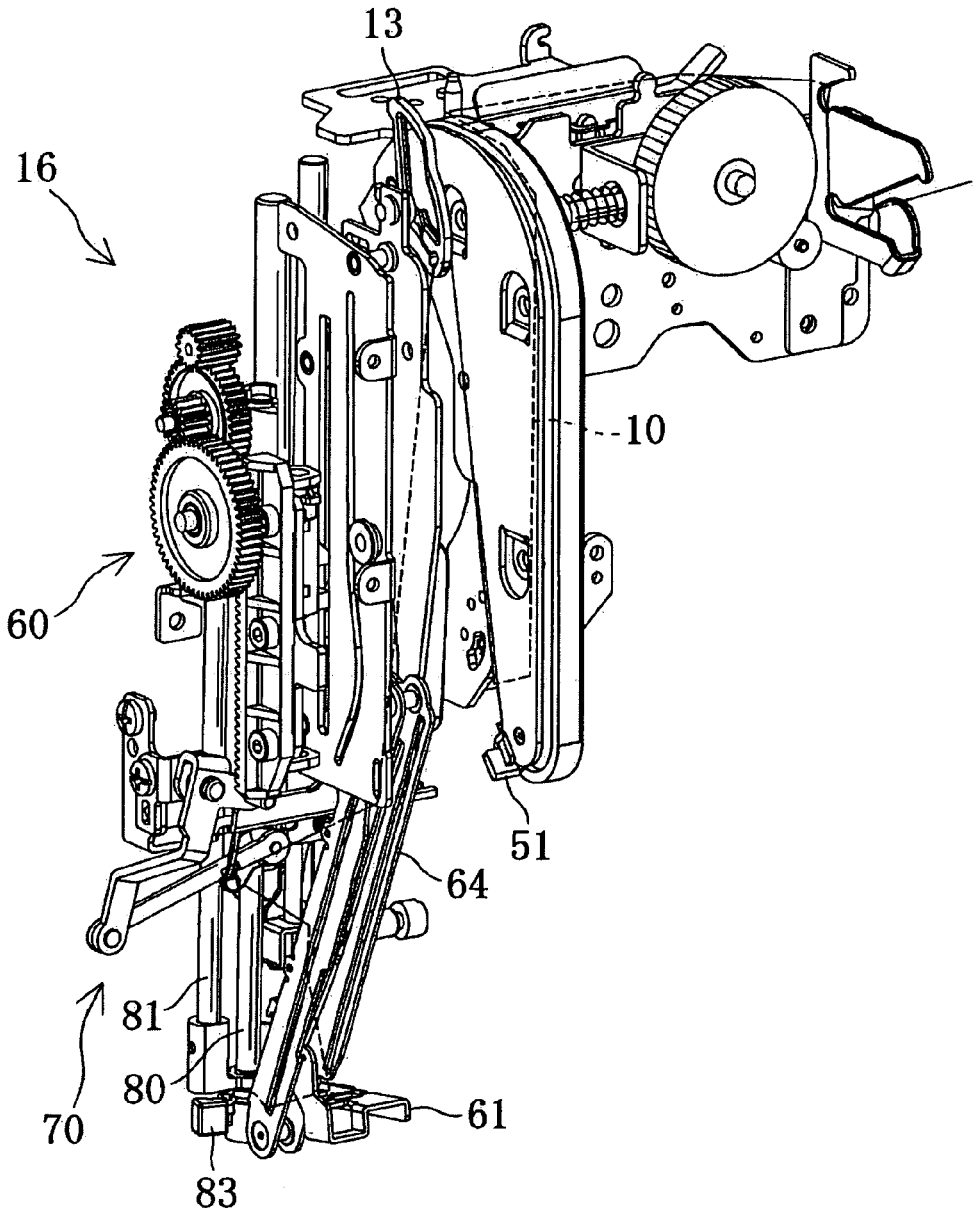
FIG. 13F is a perspective view of the automatic thread hooking device and automatic threading mechanism (thread hooked on needle bar)
Figure 14E:
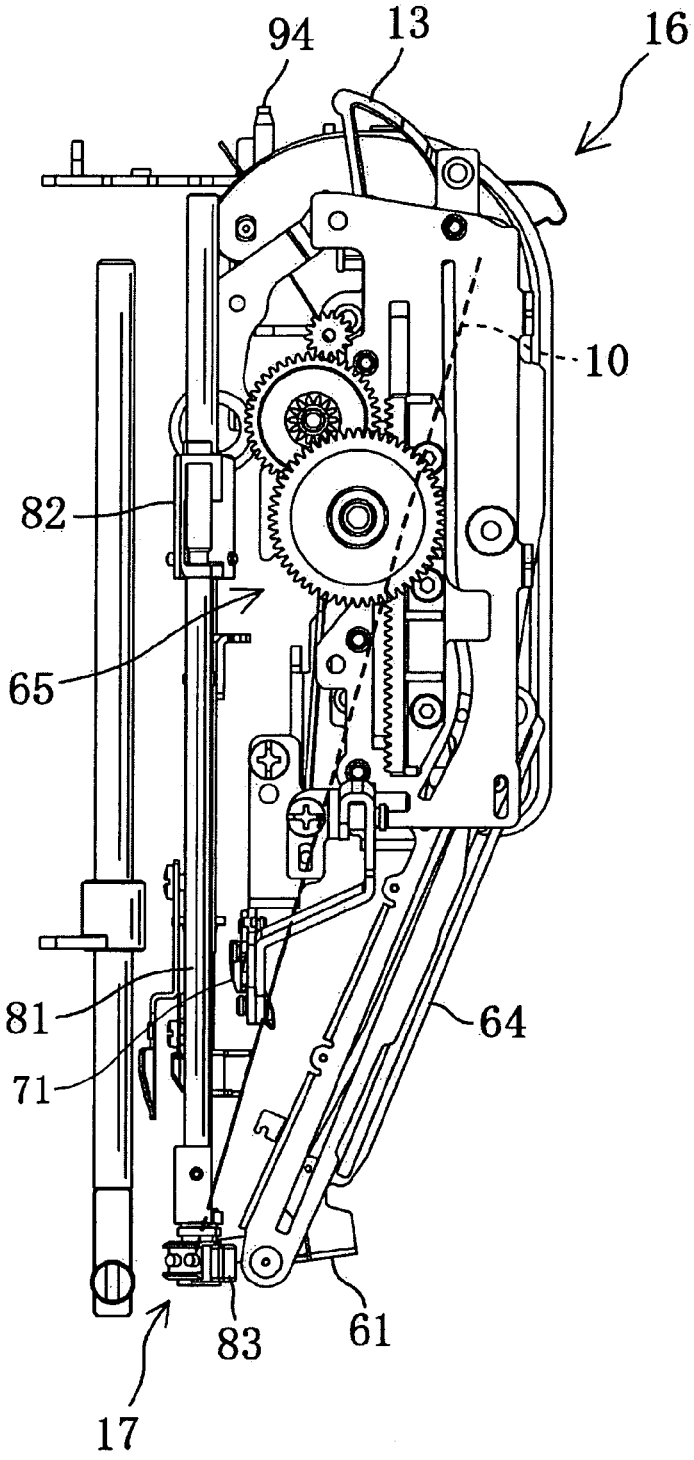
FIG. 14E is a side view of the automatic thread hooking device, automatic threading mechanism (thread turnover)
Figure 14F:
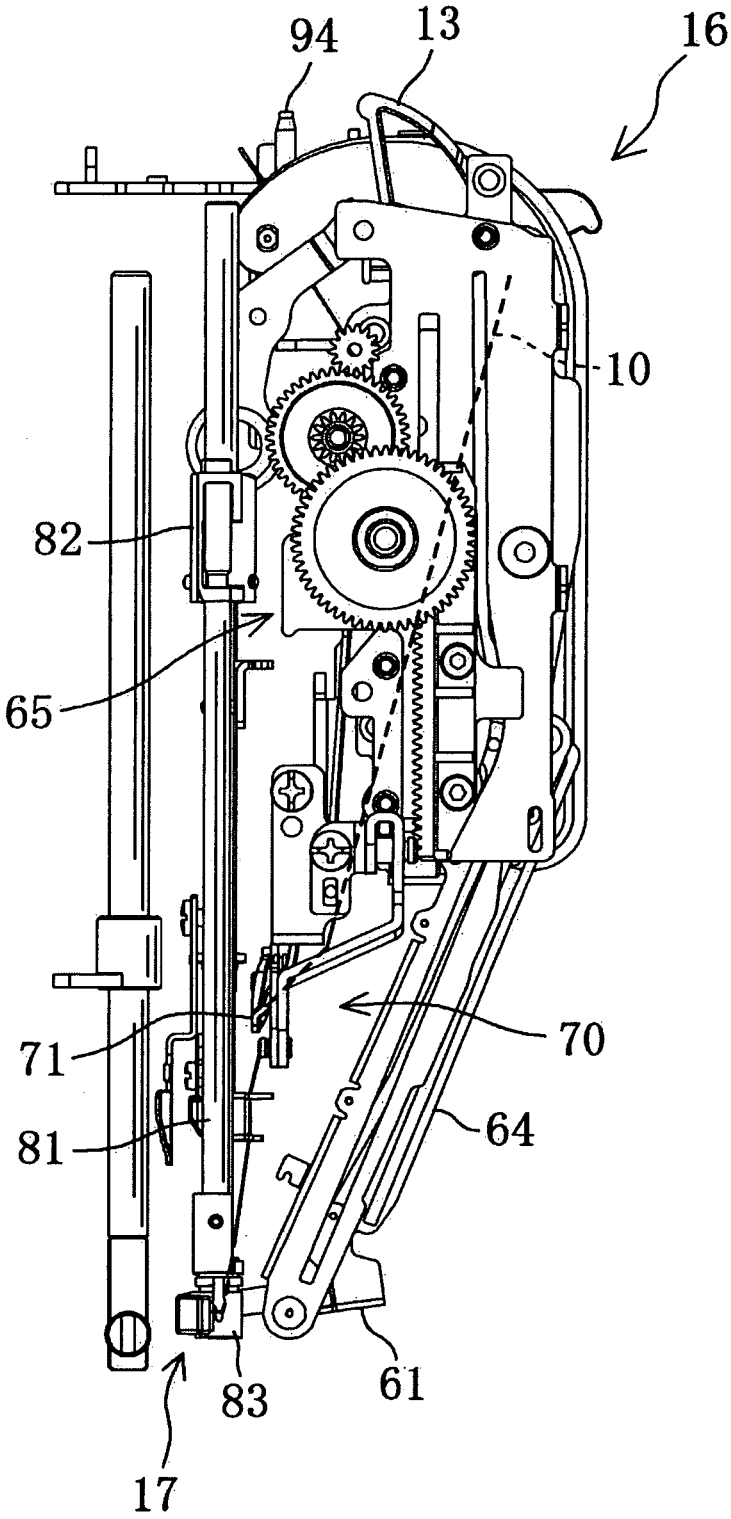
FIG. 14F is a side view of the automatic thread hooking device, automatic threading mechanism (thread hooked on needle bar)

As shown in FIGS. 12A, 13A and 14A, when the second thread transferring member 61 is in the stand-by position, it is faced downward located immediately in the front and below the thread take-up which is shifted to the thread hook position. As shown in FIGS. 12E, 13E and 14E, the second thread transferring member 61, when in the thread turnover position is rear faced in a horizontal disposition in front of the sewing needle 19.

The second carrier member 61 has a laterally paired thread retainers 61*a* and 61*b* capable of retaining the needle thread 10 in the thread preparation path 30. The thread retainers 61*a* and 61*b* are bifurcated so that they can hold the needle thread 10. However, though not shown, the left-hand thread retainer 61*a* is configured to sandwich the needle thread 10 in co-operation with a separate thread sandwiching piece.

When lowered from the stand-by position to the thread turnover position, the second thread transferring member 61 retains the needle thread 10 hooked on the thread preparation path 30 with the thread retainer 61*b* on the right-hand side and the thread retainer 61*a* on the left side to transfer it downward in a sandwiched state. Then when the second thread transferring member 61 is transferred to the thread turnover position, the needle thread 10 retained in between the thread retainers 61*a* and 61*b* of the second thread transferring member 61 is positioned immediately in front of the eye 19*a* of the sewing needle 19 and stand-bys laterally directed in a tensed state.

The second drive mechanism 65 is provided with a drive gear 66, double gears 67*a* and 67*b* and a rack forming member 68. The gears 66, 67*a*, 67*b*, the rack forming member 68 and the second stepping motor 69 are arranged on the left-hand side of the second guide frame 62. The second stepping motor 69 is fixed on the sewing machine frame and the drive gear 66 is connected to its output axis. The double gear 67*a* and 67*b* are rotatably supported by the sewing machine frame. The output gear 66 fits with the large-diameter gear of the double gear 67*a*, and the small-diameter gear of the double gear 67*a* fits with the large-diameter gear of the double gear 67*b*. The rack forming member 68 is vertically moveably guided against the second guide frame 62 and 63 and the small-diameter pinion of the double gear 67*b* is fitted to the rack 68*a*.

When the second stepping motor 69 actuated, its drive power is transmitted to rack forming member 68 via the drive gear 66, double gear 67*a* and 67*b* and rack 68*a*, and the rack forming member 68 is vertically driven. When the rack forming member 68 is vertically moved, the moveable frame 64 connected to the rack forming member 68 by a plurality of pulleys and wires (not shown) is driven approximately 2 times as fast as the rack forming member 68 while the second thread transferring member 61 connected to the moveable frame 64 via a plurality of pulleys and wires (not shown) is driven approximately 2 times as fast as the moveable frame 64 (that is, approximately 4 times as fast as the rack forming member 68).

Next, the third thread transferring mechanism 70 which captures the needle thread 10 extending from the thread take-up lever 13 to the thread retainer 61*b* located on the right-hand side of the second thread transferring member 61 with a thread hooking hook 76 and hooks the needle bar thread guide 18 on the lower end of the needle bar 11 is described.

As shown in FIGS. 9, 13A, 14A, 15A and 15B, the horizontal L-shaped support plate 71 extending in the lateral direction is fixed on the rear end of the lower end of the second guide frames 62 and 63. On the left end of this L-shaped support plate 71, the upper end of the first link 72 which is bent to form a crank (when viewed from the side) is pivotally supported by the first pivotal pin 73. On the lower end of the first link 72, the left end of the second link 74 is pivotally supported by the second pivotal pin 75. On the right end of this second link 74, the central portion in the upright direction of the thread hooking hook 76 is pivotally supported by a longitudinally directed third pivotal pin 77. The base end of the thread hooking hook 76 is pivotally supported on the pivot member 78 fixed on the bottom surface of the L-shaped support plate 71 by the forth pivotal pin 79.

Figure 16:
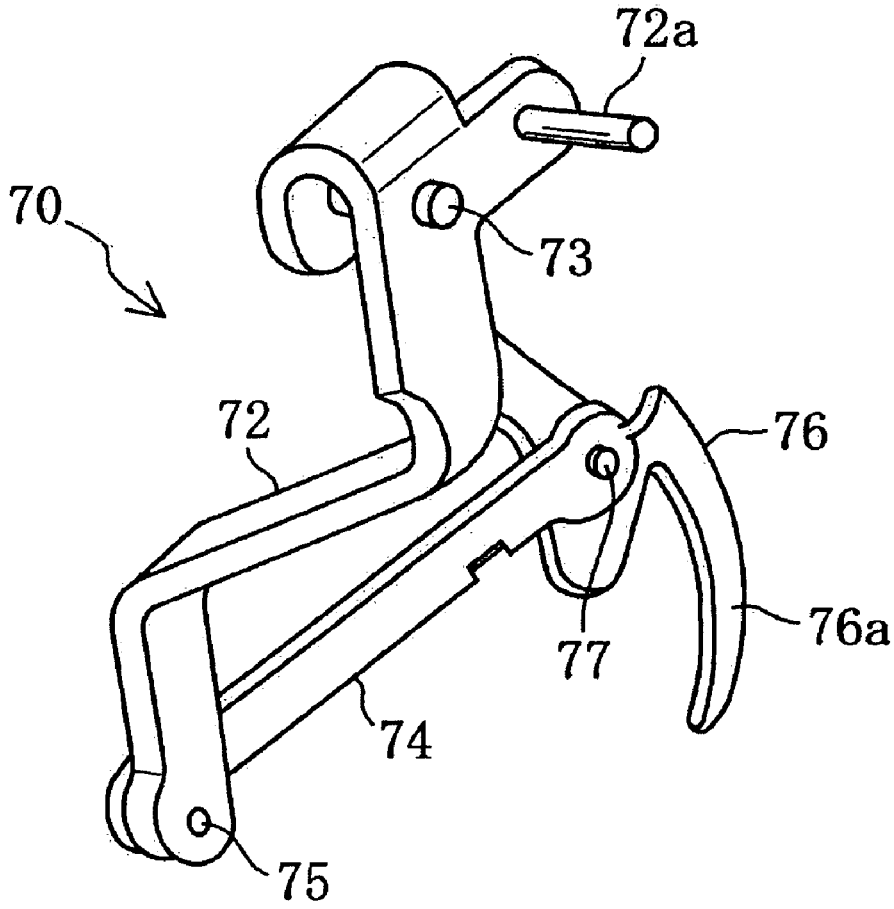
FIG. 16 is an enlarged view of the thread hooking hook.

On the end point of the thread hook member 76, a hook member 76*a* is formed. The hook 76*a* as shown in FIG. 16 is formed so that it projects further to the forward direction more towards the end point. The needle thread 10 immediately in front of the needle bar thread guide 18 as shown in FIG. 14E, is transferred towards the needle bar guide 18 in an inclined manner and the needle thread 10 is retained within the swing track of the hook 76*a*. Because of this, as described herein under, when the thread hooking hook member 76 swings, its hook 76*a* hooks the needle thread 10 and pulls the hooked thread towards the needle bar thread guide 18.

Figure 15A:
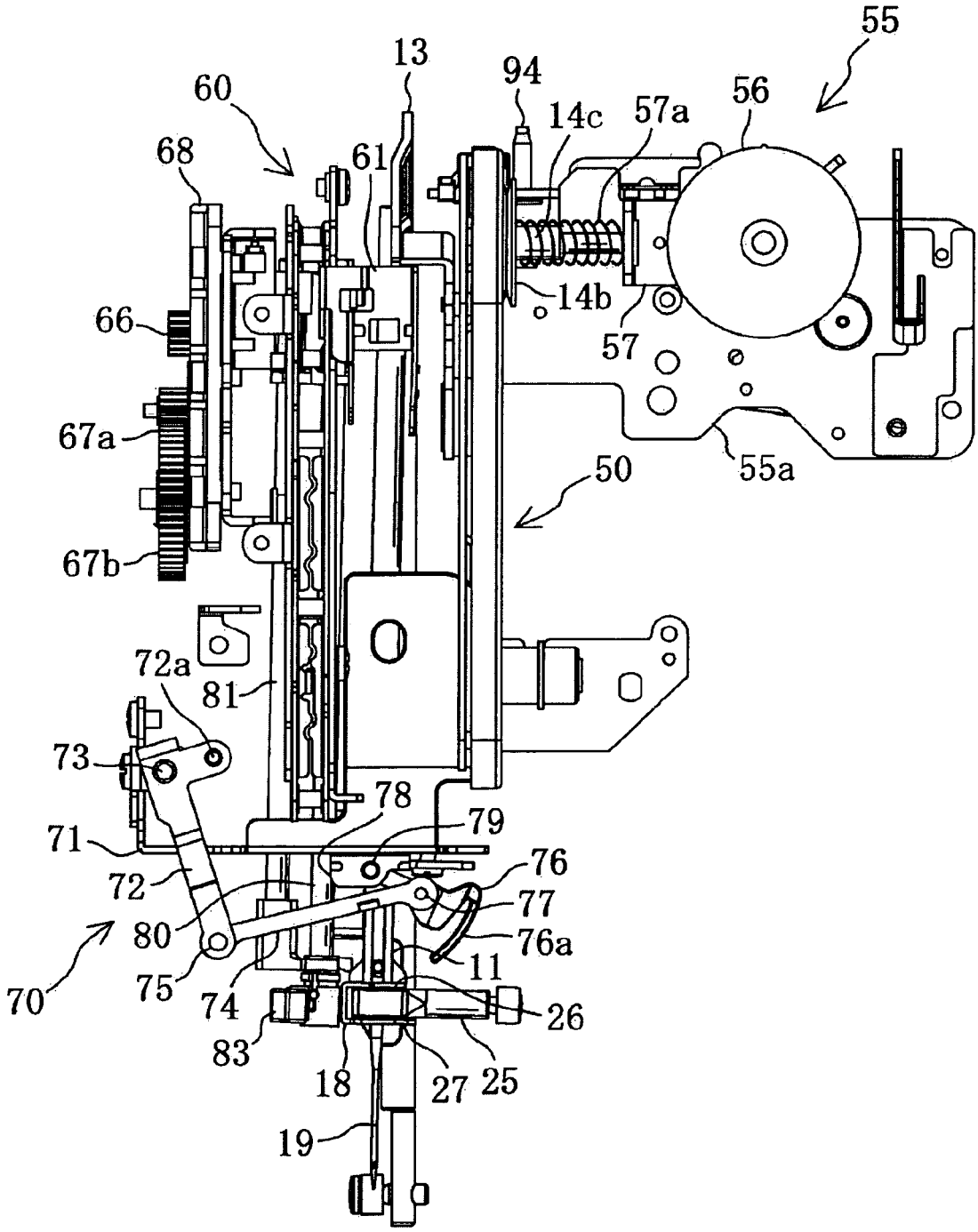
FIG. 15A is a front view of the automatic thread hooking device, automatic threading mechanism (stand-by)
Figure 15B:
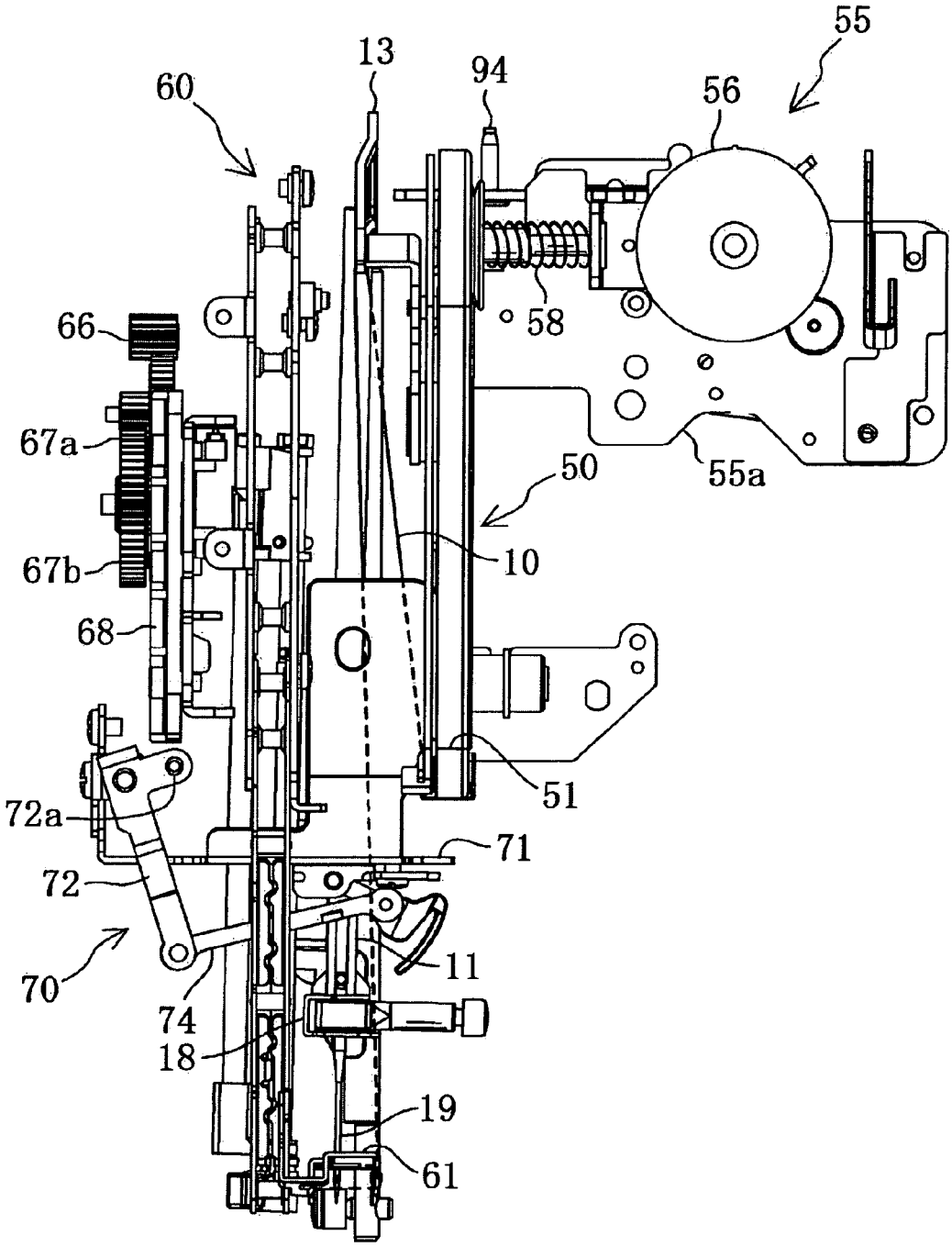
FIG. 15B is a front view of the automatic thread hooking device, automatic threading mechanism (thread turnover)
Figure 15C:
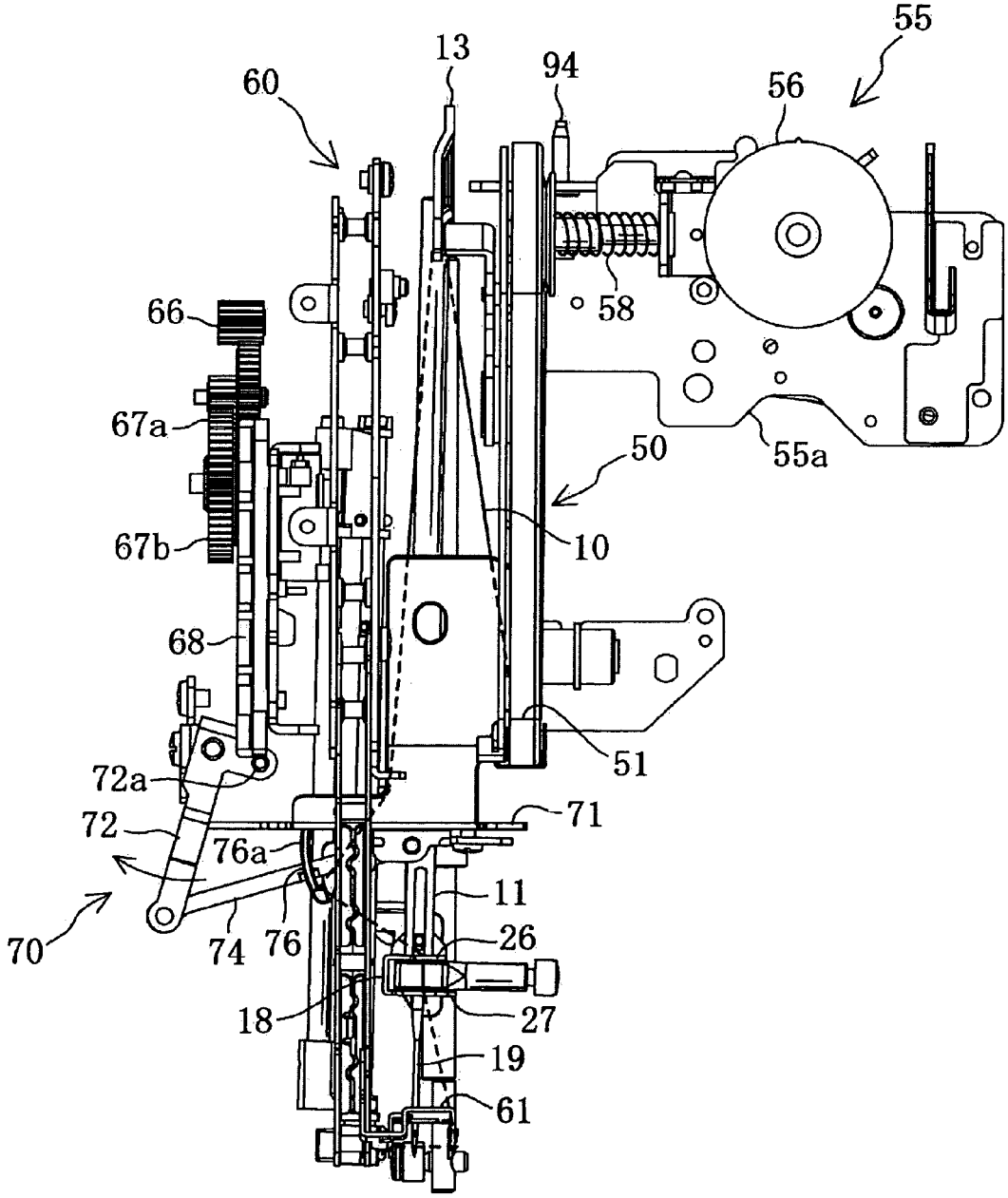
FIG. 15C is a front view of the automatic thread hooking device, automatic threading mechanism (thread hooked on needle bar)

Because the first link 72 is energized in a counter-clockwise direction (when viewed from the front) by the twist spring not shown, the thread hooking hook 76 as shown in FIG. 15A is always retracted to the right side of the needle bar 11. However, immediately before the second thread transferring member 61 reaches the thread turnover position, as shown in FIG. 15C, because the lower end of the descending rack forming member 68 contacts the actuating pin 72*a* provided on the upper end of the first link 72 from above and presses it downward for a predetermined distance, the first link 72 rotates in a clock wise direction. Because of this, the thread hooking hook 76 swings in front of the needle bar 11 in a circular-arc parallel to the vertical surface with the forth pivotal pin 79 as its rotational center and the thread hooking hook 76 as shown in FIG. 15B can be switched from the stand-by position shown in FIG. 15B to the thread hooking position shown in FIG. 15C.

When the thread hooking hook 76 moves from right to left immediately in front of the needle bar 11, as will be described herein after, the thread adjusting disk 14*a* and 14*b* of the thread tension regulator 14 is switched to a closed state and the needle thread 10 residing in the extent from thread take-up lever 13 to the thread retainer 61*b* is appropriately tensed. Moreover, because in the vicinity of the needle bar thread guide 18, the needle thread is transferred inclining towards needle bar thread guide 18, the needle thread 10 in the vicinity of the needle bar thread guide 18 is reliably caught by the hook 76*a* of the thread hooking hook 76 which swings in the vertical surface. While the thread hooking hook 76 passes the front of the needle bar 11 catching the needle thread 10 and switches to the thread hooking state, the needle thread 10 caught by the thread hooking hook 76 is hooked onto the needle bar thread guide 18.

Next, a brief description is given hereinafter on the automatic threading mechanism 17. As shown in FIGS. 8, 9, 12A to 12F, 13A to 13F and 14A to 14F, the automatic threading mechanism 17 comprises a threading axis 80 arranged vertically reciprocably in the vertical direction in the immediate left of the needle bar 11, a threading guide axis 81 arranged in the vertical direction immediately to the left of the threading axis 80 and integrally reciprocable with the threading axis 80, a threading slider 82 reciprocably outer-fitted on to the upper end of the threading axis 80 and the threading guide axis 81, and a hook mechanism having a threading hook (not shown) arranged in the lower end of the threading axis 80 and the rotational mechanism (not shown) to rotate the threading axis 80 by 90 degrees to pass the threading hook through the eye 19*a* of the sewing needle 19 at its lowest limit position. However, it needs to be noted that the threading slider 82 is reciprocably driven in synchronization with the rack forming member 68.

Because of this, the automatic threading mechanism 17 is lowered in synchronization with the second thread transferring mechanism 60 of the automatic thread hooking device 16 and immediately before the second thread transferring member 61 moves to the thread turnover position, the threading axis 80 reaches the lowest position. Then, when the threading hook of the hook mechanism rotates approximately 90 degrees to the advancing direction and passes through the eye 19*a* of the sewing needle 19, the needle thread 10 retained by the second thread transferring member 61 is hooked by the threading hook.

After that, the threading hook of the hook mechanism rotates approximately 90 degrees in the retreating direction and passes through the eye 19*a* of the needle 19. At this time, needle thread is passed through the eye 19*a*, then, the threading axis 80 is elevated to return to its original position. For more information on such operation of the threading hook and sewing needle 19, refer to FIG. 16 of JP-A-2004-41355.

Next, the thread preparation path 30 is described. As described above, the thread preparation path 30 is a path to prepare the plurality of thread hooking sections (thread tension regulator 14, check spring 15, thread take-up lever 13, needle bar thread guide 18 etc.) so that they can be hooked by the needle thread 10 extending from the thread spool 9 by the automatic thread hooking device 16. The thread hooking onto the thread preparation path 30 is manually performed in advance by the user by sequentially introducing the needle thread 10 from the thread leading groove 31 formed on the sewing machine cover 35.

As shown in FIGS. 4, 8, 12A and 13A, the lower right end portion of the pre-lead cover 35*b* is a cavity 36 caving into the left side and the thread hook member 90 and 91 facing outward from this cavity 36 is formed. Inside the sewing machine cover 35, in between the first guide frame 52 and thread hook member 91*a* plate form pretensioner 93 capable of pressing the needle thread 10 against a receptor plate 92 with suitable pressure is provided. To the left of the pretensioner 93, a vertically directed axial thread hook member 94 is provided. Immediately below the thread retainer 61*b* to the right of the second thread transferring member 61 in stand-by position and to the right side of the track of the second thread transferring member 61 the thread hook member 95 is provided.

This thread hook member 95 (refer to FIG. 13A), though details not shown, is a member to temporarily hold the needle thread 10 loosely in a prescribed position so that when the transfer of the second thread transferring member 61 is started the two thread retainers 61*a* and 61*b* can be hooked. Also, a thread hook member 96 (refer to FIG. 4) is provided to face the vertical groove of the L-shaped leading groove 34*d* located in between the thread guide cover 35*d* and screen plate 35*f*.

The needle thread 10 hooked on the thread preparation path 30 will is processed as follows. The needle thread 10 extends to the left from the thread spool 9 and hooks onto the thread hook member 90 from above and hooks onto the thread hook 91*a* in the lower portion of the thread hook member 91 from below. The needle thread 10 then extends upward to hook onto the upper-protruding thread hook 91*b* of the thread hook member 91 from the front, leads on to its right and on to the rear side to further extend to the left.

The Needle thread 10 extending to the left from the upward protruding thread hook 91*b* passes between the receptor plate 92 and pretensioner 93, hooks onto the axial thread hook 94 from the rear side, and then hooks on to the lead guide 43 of the thread take-up lever 13 in thread hook position from the rear side. The needle thread 10 in between the axial thread hook 94 and the lead guide 43 is in a position to reliably hook onto the first thread transferring member 51 which moves along the outer perimeter of the first guide frame 52 from the stand-by position to the thread turnover position.

The needle thread 10 hooked onto the lead guide 43 of the thread take-up lever 13 extends forward and downward to hook onto the thread hook member 95. Then the needle thread 10 is hooked onto the lower thread hook 96*a* of the thread hook member 96, extending upward. After hooked, the needle thread 10 is retained by the needle thread retainer 96*b* of the thread hook member 96. Then the lower stream end of the needle thread 10 is trimmed by the trimmer 97 mounted on the thread hook member 96.

In case the thread is hooked in this way, the needle thread 10 in between the thread hook member 95 and 96 laterally crosses the moving path of the pair of thread retainers 61*a* and 61*b* of the second thread transferring member 61 and when the pair of thread retainers 61*a* and 61*b* of the second thread transferring member 61 moves from the stand-by position to the thread turnover position, it is reliably hooked onto the pair of thread retainers 61*a* and 61*b* and transferred thereon.

Next, the operation and effect of the sewing machine M having the above described configuration is described. In case the needle thread 10 is broken while sewing with the sewing machine M or in case the thread spool 9 is replaced, the needle thread hooking operation is performed by the automatic threading hooking device 16. On performing the automatic thread hook, the automatic thread take-up lever 13 not positioned in the thread hook position is automatically shifted to the thread hook position and halted by operating the automatic thread hook preparation switch 23.

Next, the needle thread 10 extending from the thread spool 9 is inserted in sequence into the leading groove 34*a*, leading groove 34*b*, leading groove 34*c*, and leading groove 34*d* along the thread leading groove 31 formed on the sewing machine cover 35. Finally, the needle thread 10 is turned in the retreating direction as to cross over the thread hook member 96 facing the vertical groove of the leading groove 34*d* and hooked on the upper retainer 96 of the thread hookmember 96 in which the needle thread is as a retained tentatively to have its lower stream trimmed by the trimmer 97.

By preparing for the thread hook in the above manner, because the needle thread 10 inserted into the thread leading groove 31 has been hooked in advance on the predetermined thread preparation path 30, the needle thread 10 can readily be automatically hooked onto a plurality of thread hooking sections including thread take-up lever 13 and thread tension regulator 14. That is, as indicated in FIGS. 12A, 13A and 14A, the needle thread 10 set in the thread preparation path 30 is laterally crossed over the track of the first thread transferring member 51, hooked from behind on to the lead guide 43 of the thread take-up lever 13 in thread hook position, and laterally crossed over the moving path of the pair of thread retainers 61*a* and 61*b* of the second thread transferring member 51.

When the automatic thread hook start switch 24 is operated, the automatic thread hook is started. The first stepping motor 54 and the second stepping motor 69 are actuated nearly at the same time and the thread transfer by the first thread transferring member 51 and the thread transfer by the second thread transferring member 61 are started simultaneously. After that as indicated in FIGS. 12B, 13B and 14B, the needle thread 10 in between the axial thread hook 94 and the lead guide 43 of the thread take-up lever 13 is hooked by the thread hooking member 51*a* and transferred downward by the first thread transferring member 51.

Then the first thread transferring member 51 moves downward with the needle thread 10 hooked while the second thread transferring member 51 moves downward retaining the needle thread 10. As shown in FIGS. 12C, 13C and 14C, because of the downward transfer of the first and second thread transferring members 51 and 61, the needle thread 10 fed from the thread spool 9 after going through the thread tension regulator 14 is drawn by being pulled toward the first and second thread transferring members 51 and 61.

Because of this, among the needle thread 10 residing in between the second thread transferring member 51 and 61, the needle thread 10 hooked from the rear of the lead guide 43 of the thread take-up lever 13 is guided to the thread take-up thread lead 42 by the lead guide 43 which in turn is lead by the thread take-up thread lead 42 on to the thread take-up thread hook 41 to be hooked thereon.

At the same time, the needle thread 10 extending from axial thread hook member 94 to the first thread transferring member 51 is hooked in between the thread adjusting disks 14*a* and 14*b* of the opened thread tension regulator 14. Furthermore, as shown in FIGS. 12D, 13D and 14D, when the first thread transferring member 51 reaches the thread turnover position and thread transfer is halted, the needle thread 10 hooked on the thread hooking portion 51*a* is moved immediately below the thread lead 15*c* of the check spring 15. At this points the second thread transferring member 61 is in the position before reaching the thread turnover position.

Therefore, because the second thread transferring member 61 continues to move downward, the needle thread moved immediately below the check spring is pulled towards the second thread transferring member 61 and as shown in FIGS. 12E, 13E and 4E, the needle thread 10 moved immediately below the check spring is led to the notch 52*a* then hooked on the check spring 15 from below.

Immediately before the second thread transferring member 61 reaches the thread turnover position, that is, in the final phase of the thread hook performed by the second thread transferring member 61, because the lower end of the descending rack forming member 68 presses down the activation pin 72*a* of the first pin 72 of the third thread transferring mechanism 70 from above the thread hooking hook 76 passes the front of the needle bar 11 and switches to the thread hooking position as shown in FIGS. 12F, 13F, 14F and 15C.

Figure 10:
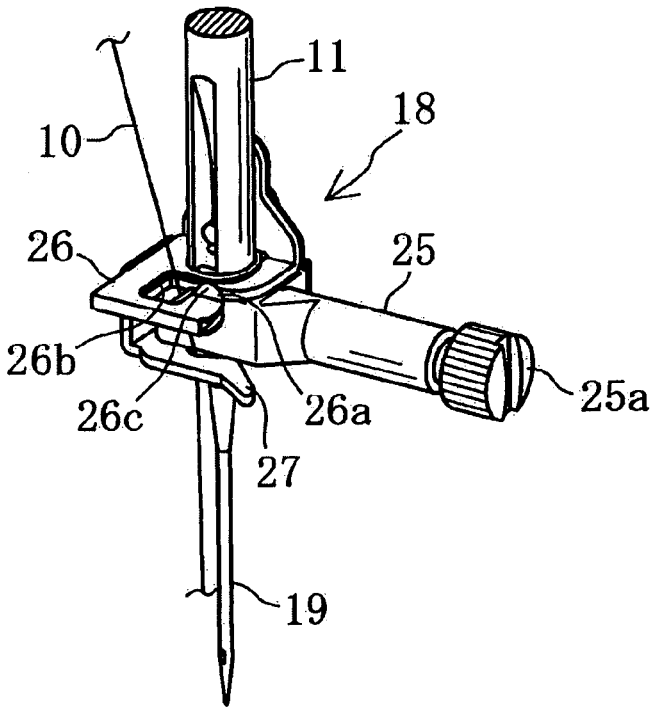
FIG. 10 is a perspective view of a needle bar thread guide.
Figure 11:
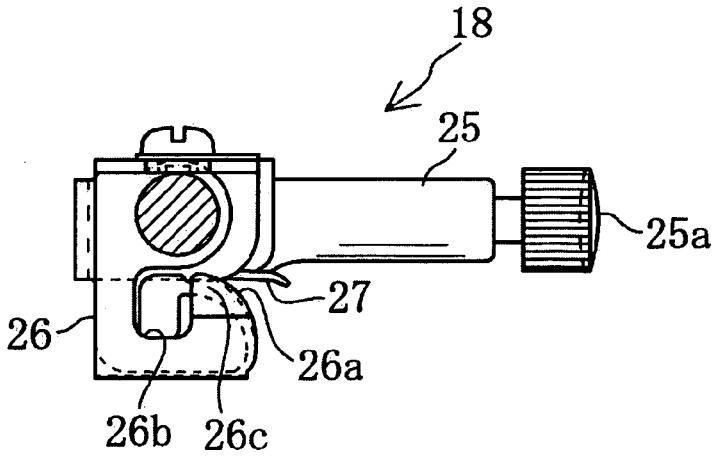
FIG. 11 is a plan view of the needle bar thread guide.

Therefore, as described earlier, because the needle thread 10 transferred to the vicinity of the needle bar thread guide 18 is more inclined towards the needle bar in its lower stream, it is reliably caught by the hook 76*a* of the thread hooking hook 76 swung in the vertical surface. The thread hooking hook 76 then passes the front side of the needle bar 11 with the needle thread 10 caught to be switched to the thread hook position. During the process of the switch to the thread hook position, as shown in FIG. 10, the needle thread 10 caught by the thread hooking hook member 76 is pulled toward the needle bar thread guide 18 and reliably hooked onto the needle bar thread guide 18.

Thus, when the needle thread 10 is hooked onto the needle bar thread guide 18 during the switch of the thread hooking hook 76 to the thread hook position, the needle thread 10 is hooked onto the needle bar thread guide 18 via the lead inlet 26*a* and withholding hook 26*c*. Therefore, though it is a simple movement to switch the thread hooking hook 76 from the stand-by position to the thread hook position, the needle thread 10 can be easily hooked from the lead inlet 26*a* of the needle bar thread guide 18 to the thread guide 26*b*. Moreover, in the needle bar thread guide, the slip-off of the needle thread 10 once hooked on the thread guide 26*b* can be reliably prevented because of the withholding hook 26*c* functioning like a check valve.

On the other hand, in synchronization with the automatic thread hooking device 16, the threading guide axis 81 of the automatic threading mechanism 17 starts to descend. When the second thread transferring member 61 reaches the thread turnover position, the threading axis 80 and threading guide axis 81 descends integrally with the threading slider 82 and reach the lowest limit position, wherein the descending movement of the threading axis and threading guide axis 81 is halted. At this point, the threading hook is level with the eye 19*a* of the sewing thread.

After that, the descent of the threading slider 82 induces the rotation of the threading hook of the hook mechanism 83 about the vertical axis, the rotation of which is driven by the rotation mechanism. Then the threading hook passes through the eye 19*a* of the needle bar and hooks the needle thread retained by the second thread transferring member 61 onto the threading hook. After that, the threading hook of the hook mechanism 83 rotates to the opposite direction and passes through the eye 19*a* of the sewing needle 19 to thread the needle thread through the eye 19*a*.

Then, the threading slider 82, threading axis 80 and threading guide axis 81 are respectively elevated to their original position. Also, the first and second thread transferring member 51 and 61 respectively are returned to their original position. Therefore, at this point, thread hooking for sewing is completed and sewing can be readily performed.

As described above, in this sewing machine M, in the final phase of the thread hook performed by the second carrier member 61 of the second thread transferring mechanism 60, in which the second thread transferring member 61 is transferred to the vicinity of the eye 19*a* of the sewing needle 19, the thread hook member 76 is swung from the stand-by position to the thread turnover position in parallel with the vertical surface. By the swing of this thread hook member 76, the needle thread 10 in between the second thread transferring member and the thread take-up is caught and reliably hooked onto the needle bar thread guide 18 provided in the lower end of the needle bar 11.

Also, by configuring the thread guide thread hooking mechanism 70 by the link mechanism comprising the first and the second link 72 and 74 and the thread hook member 76, the thread hook member 76 is arranged to simply swing in parallel to the vertical surface which, substantially simplifies the configuration of the thread guide thread hook mechanism 70 and provides advantageous cost benefits as well as installability. Furthermore, the space required for the installation of thread guide thread hook mechanism 70 can be reduced.

Also, because the thread guide thread hooking mechanism 70 is driven to perform the thread hook by the descending drive power of the rack forming member 68 which is a part of the second thread transferring mechanism 60 and which is vertically driven by the second drive mechanism 65, the thread guide thread hooking mechanism 70 can be driven in conjunction with the rack forming member 68 without the provision of a dedicated drive actuator. Therefore, the thread guide thread hooking mechanism can be simplified all the more by omitting the drive units.

Also, when the second thread transferring member 61 is moved to the vicinity of the eye 19*a* of the needle bar 19, the thread hooking member 76 is swung from the stand-by position to the thread turnover position via the link mechanism in a manner to avoid the interference of the second thread transferring member 61. Because of this, the thread hook to the needle bar thread guide 18 can be driven in the most appropriate timing in correlation with the second thread transferring mechanism 60, without adjusting the thread transferring timing of the second thread transferring member 61 of the second thread transferring mechanism 60 with the actuation of the repositioning of the thread guide thread hooking mechanism 70.

Also, the thread hooking hook member 76 is supported rotatably in its base end, and is provided with a hook 76*a* to perform the thread hook. The stand-by position of the thread hooking member 76 is set in a predetermined distance above the needle clamp member 25 which detachably fixes the sewing needle 19 to the needle bar 11. Because of this, in attaching/detaching the sewing needle fixed by the needle clamp member 25, the attaching/detaching operation of the sewing needle 19 can be performed easily and swiftly without any interruption of the thread hooking member 76. Furthermore, sewing work can progress uninterruptedly without the thread hooking member 76 blocking the sight around the needle bar 11.

Also, the thread hooking member 76 is provided with hook 76*a* which engages with the needle thread in the vicinity of the needle bar thread guide 18. The thread hooking member 76*a* is driven to switch from the stand-by position, in which the thread hooking member 76*a* can be engaged to the needle thread transferred by the second thread transferring member 61 toward the needle bar guide 18 in the vicinity of the needle bar thread guide 18, to the thread hooking position, in which the needle thread is caught by the hook 76*a* to be hooked onto the needle bar guide 18. Because of this, though it is a simple operation, in which the rack forming member 68 is merely switched from the stand-by position to the thread hooking position, the reliability of the engagement between the thread hooking member 76 and the needle thread in the vicinity of the needle bar thread guide 18 can be secured.

The present invention can be implemented by incorporating various changes, for example, to the thread guide thread hooking mechanism 70 etc. to the extent that they do not deviate from the intensions of the present invention.

The present invention is applicable to domestic and also industrial sewing machines. Other forms of implementation incorporating various changes to the above embodiment are also possible and the present invention includes such forms incorporating the various changes.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A sewing machine comprising:

a needle bar supporting a sewing needle;

a thread take-up lever;

a needle thread supply;

a thread tension regulator;

a plurality of thread hooking sections including the thread take-up lever and the thread tension regulator;

a needle threading mechanism to automatically pass a needle thread through an eye of the sewing needle;

a thread transferring mechanism having a thread transferring member to retain and transfer the needle thread extending from the thread supply, wherein the thread transferring member is moveably arranged to operate up to the vicinity of the eye of the sewing needle and hook the needle thread on the thread take-up lever in the process of the transfer of the thread transferring member as well as having the capability of passing the needle thread through the eye of the sewing needle in co-operation with the needle threading mechanism when transferred to the vicinity of the eye;

a needle bar thread guide provided on the lower end of the needle bar; and a thread guide thread hook mechanism having a thread hook member that is moveable in a vertical plane substantially parallel to a longitudinal axis of the needle bar, that is movable along a vertical surface of the needle bar from the stand-by position to the thread hooking position and that hooks the needle thread in the extent from the thread transferring member moved to the vicinity of the eye to the thread take-up lever to hook the needle thread onto the needle bar thread guide.

2. The sewing machine according to claim 1, wherein the thread transferring mechanism is arranged to be driven to perform the thread hook by the descending driven power of the moveable member which is vertically driven by the thread transferring mechanism.

3. The sewing machine according to claim 1, wherein the thread guide thread hook mechanism is provided with a link mechanism to swing the thread hooking hook member and the thread hooking member is arranged to swing in parallel to the vertical surface via the link mechanism.

4. The sewing machine according to claim 3, wherein the thread hooking hook member is arranged to swing from the stand-by position to the thread turnover position via the link mechanism in a manner that avoids the interference with the thread transferring member when the thread transferring member is moved to the vicinity of the eye of the sewing needle.

5. The sewing machine according to claim 1, wherein the thread hooking hook member is supported rotatably in a base end thereof with a hook on an end point thereof to perform the thread hook and furthermore, the stand-by position of the thread hooking member is set in a predetermined distance above the needle clamp member which detachably fixes the sewing needle to the needle bar.

6. The sewing machine according to claim 4, wherein the thread hooking member is supported rotatably in a base end with a hook on an end point thereof to perform the thread hook and furthermore, the stand-by position of the thread hooking member is set in a predetermined distance above the needle clamp member which detachably fixes the sewing needle to the needle bar.

7. The sewing machine according to claim 1, wherein the needle bar thread guide is provided with an leading inlet to lead the needle thread; a thread guide concatenated with the leading inlet; a withholding hook to withhold the needle thread in between the leading inlet and the thread guide so that the needle thread hooked on the leading inlet does not slip off; and the thread hooking member is arranged to hook the needle thread on the thread guide during the switch from the stand-by position to thread hooking position via the leading inlet 26*a* and the withholding hook.

8. The sewing machine according to claim 6, wherein the needle bar thread guide is provided with an leading inlet to lead the needle thread; a thread guide concatenated with the leading inlet; a withholding hook to withhold the needle thread in between the leading inlet and the thread guide so that the needle thread hooked on the leading inlet does not slip off and the thread hooking member is arranged to hook the needle thread on the thread guide during the transfer to switch from the stand-by position to thread hook position via the leading inlet 26*a* and the withholding hook.

* * * * *